US010800631B2

(12) United States Patent
Kubo et al.

(10) Patent No.: US 10,800,631 B2
(45) Date of Patent: Oct. 13, 2020

(54) SHEET STACKING APPARATUS AND IMAGE FORMING SYSTEM

(71) Applicants: Mamoru Kubo, Yamanashi-ken (JP); Hiroto Akiyama, Yamanashi-ken (JP); Ichitaro Kubota, Yamanashi-ken (JP); Hiroki Honmochi, Yamanashi-ken (JP); Takashi Saito, Yamanashi-ken (JP); Kota Hihara, Yamanashi-ken (JP)

(72) Inventors: Mamoru Kubo, Yamanashi-ken (JP); Hiroto Akiyama, Yamanashi-ken (JP); Ichitaro Kubota, Yamanashi-ken (JP); Hiroki Honmochi, Yamanashi-ken (JP); Takashi Saito, Yamanashi-ken (JP); Kota Hihara, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 16/271,216

(22) Filed: Feb. 8, 2019

(65) Prior Publication Data

US 2019/0248615 A1 Aug. 15, 2019

(30) Foreign Application Priority Data

Feb. 9, 2018 (JP) ..... 2018-022536

(51) Int. Cl.
*B41J 13/10* (2006.01)
*B65H 31/02* (2006.01)
(Continued)

(52) U.S. Cl.
CPC ..... *B65H 31/02* (2013.01); *B41J 13/106* (2013.01); *B65H 31/12* (2013.01);
(Continued)

(58) Field of Classification Search
CPC .... B65H 31/02; B65H 2801/27; B65H 31/36; B65H 2801/06; B65H 2301/4212;
(Continued)

(56) References Cited

U.S. PATENT DOCUMENTS

| | | | | |
|---|---|---|---|---|
| 6,341,934 B1 * | 1/2002 | Takeno | ..... | B65H 31/30 270/58.23 |
| 2013/0134645 A1 * | 5/2013 | Kato | ..... | B65H 31/00 270/58.07 |
| 2015/0023765 A1 * | 1/2015 | Hongu | ..... | B65H 31/38 412/33 |

FOREIGN PATENT DOCUMENTS

| | | | | |
|---|---|---|---|---|
| JP | 2004098504 A * | 4/2004 | ..... | B41J 2/01 |
| JP | 2015-16970 A | 1/2015 | | |
| JP | 2017-132636 A | 8/2017 | | |

* cited by examiner

*Primary Examiner* — Yaovi M Ameh
(74) *Attorney, Agent, or Firm* — Manabu Kanesaka

(57) ABSTRACT

To enable a bunch of sheets to be reliably discharged to a stack tray, also in the case where weight of the bunch of sheets formed on a processing tray is large, a post-processing control section receives information on an ink discharge amount, the number of sheets, sheet type, and printing mode (two-side/one-side) in printing on sheets from a main body control section of an image forming unit A, in forming a bunch of sheets on the processing tray. The control section thereby recognizes weight of a bunch of sheets formed on the processing tray, and when the section determines that the weight is heavier than predetermined weight, decreases a rotation velocity of a drive motor of a sheet bunch transport means, or increases a current amount applied to the drive motor. By this means, torque of the motor is increased, and the bunch of sheets is reliably discharged to the first stack tray.

12 Claims, 10 Drawing Sheets

(51) Int. Cl.
*G03G 15/00* (2006.01)
*B65H 31/12* (2006.01)
*B65H 31/36* (2006.01)

(52) U.S. Cl.
CPC ..... *G03G 15/5029* (2013.01); *B65H 31/36* (2013.01); *B65H 2301/4212* (2013.01); *B65H 2801/06* (2013.01); *B65H 2801/27* (2013.01); *G03G 2215/00915* (2013.01)

(58) Field of Classification Search
CPC ..... B65H 31/12; G03G 15/5029; G03G 2215/00915; B41J 13/106
See application file for complete search history.

FIG. 4A PADDLE UPWARD POSITION SHEET DISCHARGE
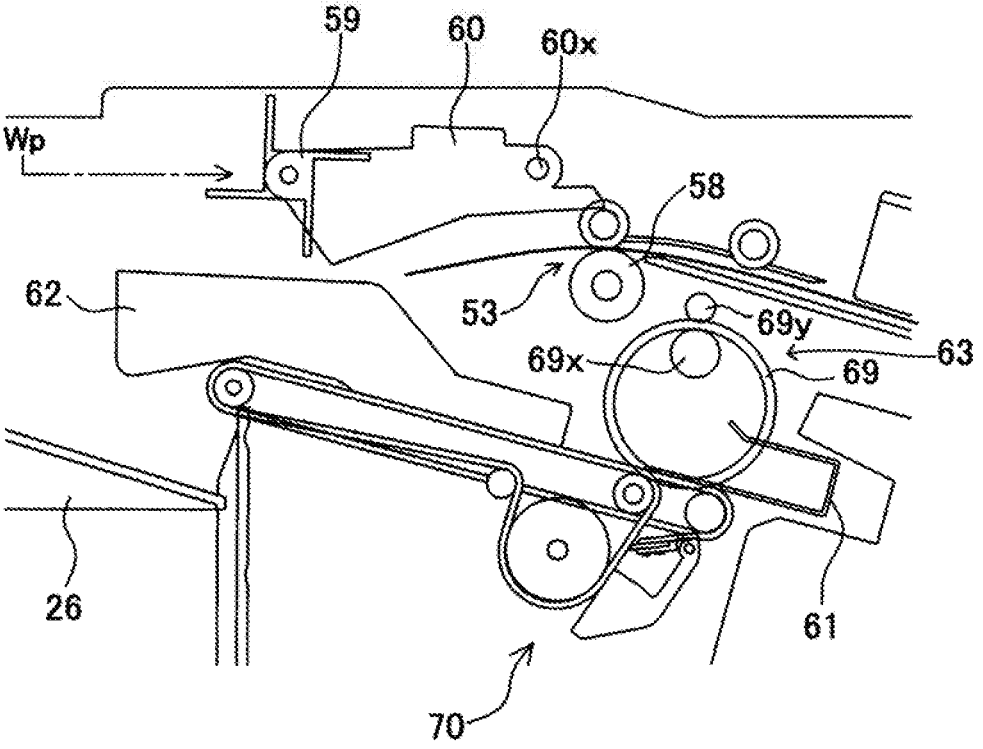
FIG. 4B PADDLE DOWNWARD POSITION
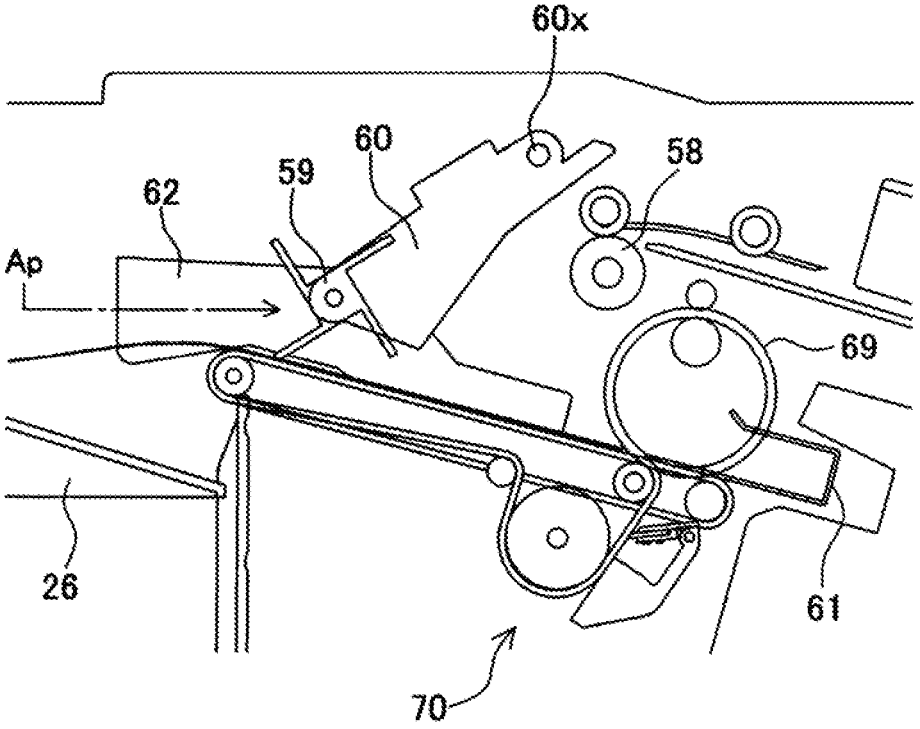

SHEET STACKING APPARATUS AND IMAGE FORMING SYSTEM

TECHNICAL FIELD

The present invention relates to an image forming system, for example, such as an inkjet printer which performs printing on transported media such as sheets.

BACKGROUND ART

Conventionally, image forming systems have been known where an image forming apparatus performs printing processing on sheets, printed sheets are once stacked on a processing tray to form a bunch of sheets, subsequently post-processing such as binding processing is performed, and the bunch is discharged to a stack tray (for example, Patent Document 1). In such an image forming system, in recent years, there has been a growth of the inkjet type of image forming section, and a system is also known where post-processing is performed on sheets printed by the inkjet type (for example, Patent Document 2).

PRIOR ART DOCUMENT

Patent Document

[Patent Document 1] Japanese Patent Application Publication No. 2015-016970

[Patent Document 2] Japanese Patent Application Publication No. 2017-132636

DISCLOSURE OF INVENTION

Problems to be Solved by the Invention

In the case of performing printing processing on sheets by the inkjet type as described in the above-mentioned patent documents, when printing is performed using a large amount of ink with respect to a sheet (for example, printing of overall solid image), the sheet becomes heavy due to moisture of the ink. When a plurality of such heavy sheets is stacked on a processing tray to form a bunch of sheets, and the bunch is discharged to a stack tray as in a normal bunch of sheets, a drive force of a sheet bunch discharge means to discharge the bunch of sheets loses against weight of the bunch of sheets (for example, loss of synchronization of a motor, etc.), and there is a possibility that the bunch is normally not discharged.

The present invention was made in view of the above-mentioned respect, and it is an object of the invention to provide a sheet stacking apparatus and image forming system capable of discharging a bunch to a stack tray, also in the case where weight of the bunch of sheets formed on a processing tray is large.

Means for Solving the Problem

The present invention adopts the following configuration to attain the above-mentioned object.

In a sheet stacking apparatus which receives sheets subjected to printing processing in an image forming apparatus and forms a bunch of sheets to discharge, the apparatus is provided with a first sheet placement section to place a sheet, a sheet bunch forming section that forms a bunch of sheets including the sheet in a state in which the sheets are supported on the first sheet placement section, a sheet shift section that shifts the bunch of sheets formed by the sheet bunch forming section in a predetermined shift direction, a drive section that drives the sheet bunch shift section, a second sheet placement section to place the bunch of sheets shifted by the sheet shift section, a recognizing section that recognizes weight of the bunch of sheets placed on the first sheet placement section, and a control section that controls the drive section to increase a transport force per unit time in shifting the bunch of sheets with the sheet shift section, when the recognizing section recognizes that the bunch of sheets is heavy, as compared with the case of recognizing that the bunch of sheets is light.

Advantageous Effect of the Invention

According to the above-mentioned configuration, the present invention enables a bunch to be reliably discharged to the stack tray, also in the case where weight of the bunch of sheets formed on the processing tray is large.

BRIEF DESCRIPTION OF DRAWINGS

FIGS. 4A and 4B contain explanatory views of a sheet carry-in mechanism in the apparatus of FIG. 2, where FIG. 4A illustrates a state in which a paddle rotating body is in a waiting position, and FIG. 4B illustrates a state in which the paddle rotating body is in an engagement position;

FIG. 7A illustrates a waiting state, FIG. 7B illustrates a relay state, FIG. 7C illustrates a structure of a second bunch transport member, and FIG. 7D illustrates a state in which a bunch is discharged to a first stack tray;

BEST MODE FOR CARRYING OUT THE INVENTION

Figure 1:
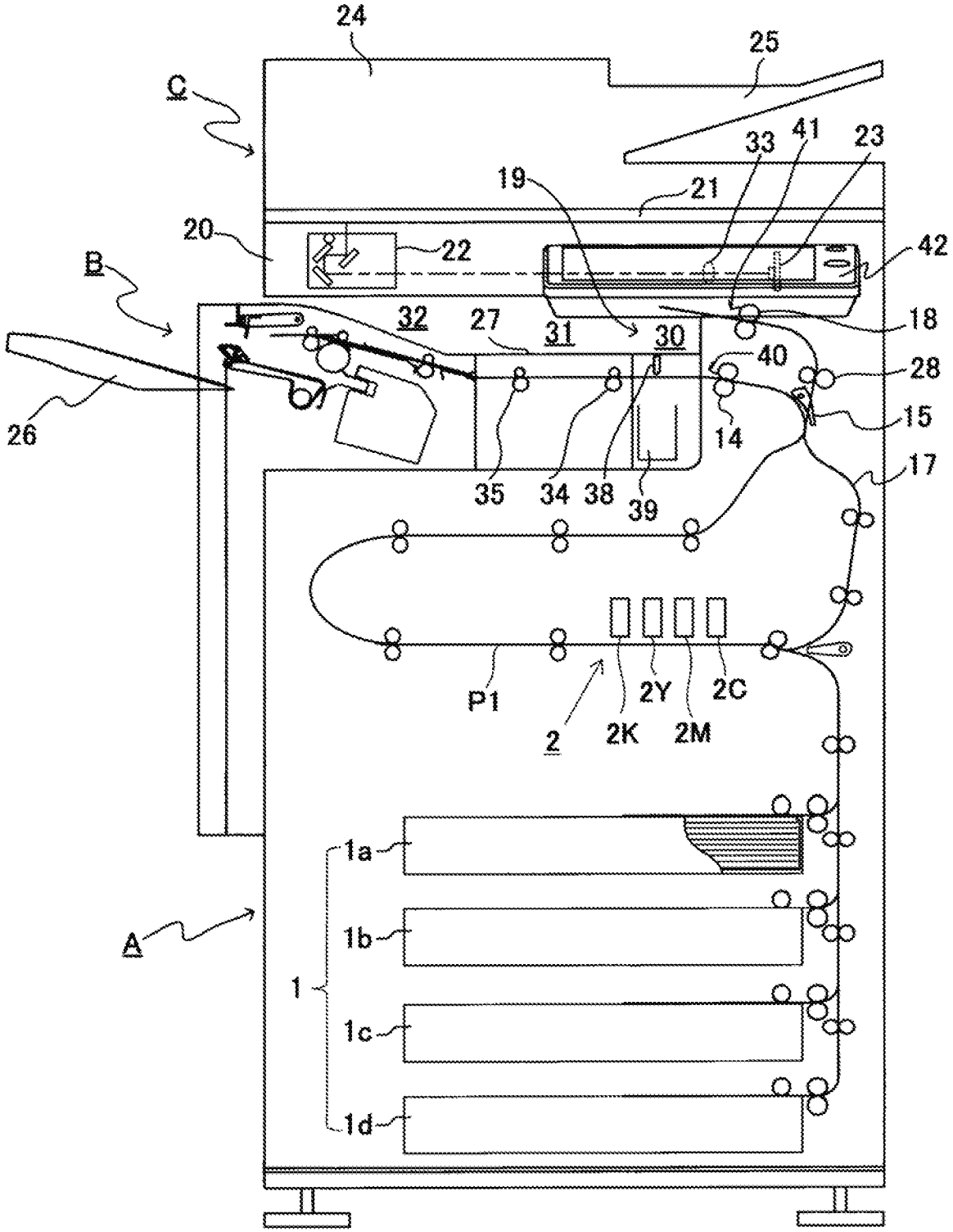
FIG. 1 is an explanatory view of the entire configuration of an image forming apparatus provided with a sheet binding apparatus according to the present invention.

A sheet post-processing unit B as a discharge unit according to the present invention and image forming unit A to attach the unit B will be described below with reference to drawings. FIG. 1 is an explanatory view illustrating the entire configuration of an image forming system with the image forming unit A, sheet post-processing unit B and image read unit C combined. An image of an original document and the like is read with the image read unit C, and the image is formed on a sheet in the image forming unit A based on the image data. Then, the image-formed sheet is punched, collated and stacked to undergo binding processing in the sheet post-processing unit B, and is stacked on a first stack tray (first stack section) positioned on the downstream side in a sheet transport direction. Alternatively, sheets on which the processing is not performed in the sheet post-processing unit B are stacked on a second stack tray (second stack section, third stack section, fourth stack section) above the sheet post-processing unit B.

The sheet post-processing unit B described later is incorporated into sheet discharge space 19 formed in a housing of the image forming unit A as a unit, and is comprised of a punch unit 30 which performs punching processing on the image-formed sheet fed to a first discharge outlet 40 (first discharge section), a relay transport unit 31 which passes the sheet between units, and a sheet binding unit 32 which collates sheets on a processing tray to stack, performs binding processing, and then, stacks on the first stack tray disposed on the downstream side in the sheet transport direction. Further, although not shown in the figure, without providing the punch unit 30 which performs punching processing on a sheet and the relay transport unit 31 which passes a sheet between units, such a form may be adopted that the sheet binding unit 32 directly receives a sheet fed from the first discharge outlet 40.

Further, for selection of a read mode (one-side read, two-side read, color, monochrome read, etc.) in the image read unit C, selection of an image formation mode (selection of one-side printing, two-side printing, sheet size, etc.) in the image forming unit A, and selection of a processing mode (punching, binding, etc.) in the sheet post-processing unit B, an operation section 42 is provided so that an operator for operating the image forming apparatus operates, and checks information and state with respect to the apparatus.

In addition, in the description of the apparatus, the apparatus front side Fr refers to the front side of the apparatus where an operator for using the apparatus executes various kinds of operation. Normally, on the apparatus front side Fr are disposed the operation section 42 (operation panel) to input processing to the apparatus and display a state of the apparatus, an installation cover (door) of a paper feed cassette of the image forming apparatus, or an open/close cover to refill a stapler unit with staples. Further, for example, the apparatus rear side Re refers to the side (in design of the apparatus, design condition where a wall exists at the rear) facing the wall of the structure when the apparatus is installed. Furthermore, in each cross-sectional view in viewing the apparatus from the front side, unless otherwise specified, a shift from the right to the left is assumed to be a discharge direction of a sheet.

[Image Forming Unit]

The image forming unit A shown in FIG. 1 uses the inkjet type, a paper feed section 1 comprised of four-stage paper feed cassettes 1*a*, 1*b*, 1*c*, 1*d* for storing sheets is disposed below an image forming section 2, the sheet-post processing unit B is disposed above the image forming section 2, and the image read unit C is further provided above the unit B. Accordingly, the arrangement of the sheet post-processing unit B is the so-called in-body installation type of apparatus using space between the image read unit C and the image forming section 2. When the sheet post-processing unit B is not installed in the image forming unit A, it is possible to also use the sheet discharge space 19 between the image forming section 2 and the image read unit C, as a stack section to stack sheets discharged from the image forming section 2.

The image forming section 2 adopts the inkjet type. In other words, color components of four colors are respectively used in printing heads (cyan 2C, magenta 2M, yellow 2Y, and black 2K) to perform printing processing on a sheet passing on a transport path P1.

The sheet with the image thus formed thereon is fed toward the sheet post-processing unit B from the first discharge outlet 41 by a first main body discharge roller 14. In the case of performing image formation on two sides of the sheet, a front end of the sheet in the transport direction is directed toward a second discharge outlet 41 by a switch gate 15. Subsequently, until a rear end of the sheet is detected by a sensor not shown, the sheet is transported by a transport roller 28 and second main body discharge roller 18. When the rear end of the sheet is detected, transport of the sheet is halted, the sheet transported toward the second discharge outlet 41 is switched back, and is transported to a circulation path 17 to feed to a second transfer roller 10 again, and an image is formed on the backside of the sheet.

For the image-formed sheet, corresponding to the processing performed subsequently or the size of the sheet, the discharge outlet is selected to discharge from the image forming unit A. In the case of selecting the processing for performing punching or binding on the sheet, the sheet is discharged from the first discharge outlet 40 to the sheet post-processing unit B, is subjected to the punching processing in the punch unit 30 corresponding to selection, is transported to the sheet binding unit 32 via the relay transport unit 31, is subjected to the binding processing corresponding to selection, and is stacked on the first stack tray. In contrast thereto, in the case where a long sheet (e.g., size longer than 420 mm in the longitudinal direction of A3) incapable of being stored on the first stack tray is selected and is subjected to image formation, the sheet is discharged from the second discharge outlet 41 (second discharge section), and is stacked on the second stack tray provided above the sheet post-processing unit B.

[Image Read Unit]

The image read unit C is comprised of an image read apparatus 20, and an automatic document feed apparatus 24. The image read apparatus 20 is comprised of platen 21, and a read carriage 22 that reciprocates along the platen 21. The platen 21 is formed of transparent glass, and it is configured to be able to select a static image read mode for placing a target original document on the top surface of the platen 21, and shifting the read carriage 22 to read, or a travel image read mode for halting the read carriage 22 in a predetermined position to read an original document transported at a predetermined transport velocity by the automatic document feed apparatus 24.

The read carriage 22 is comprised of a light source lamp, and reflecting mirrors that deflect reflected light from the original document. The reflected light of the original document deflected by the reflecting mirror is applied to a photoelectric converter mounted on a CCD board 23 via a condenser lens. The photoelectric converter is comprised of line sensors arranged in the original document width direction (main scanning direction) on the platen 21, and the read carriage 22 reciprocates and shifts in the sub-scanning direction orthogonal to the main scanning direction, and thereby reads the original document image in a line sequential manner. The automatic document feed apparatus 24 for transporting the original document at the predetermined velocity is mounted on the image read apparatus 20. The automatic document feed apparatus 24 is comprised of a feeder mechanism which feeds original document sheets set on an original document stacker 25 to the platen 21 on a sheet-by-sheet basis, and after reading the image, stores in a sheet discharge tray.

[Punch Unit]

In the punch unit 30 is disposed a punching means 38 for performing punching processing on the sheet which is discharged from the first discharge outlet 40 and passes a sheet transport path inside the punch unit 30. On the upstream side of the punching means 38 in the sheet transport direction, the first main body discharge roller 14 for transporting the sheet is disposed and is coupled to a drive motor not shown. A control section (CPU, etc.) not shown connected to a motor driver for transmitting a drive signal to the drive motor is configured to halt the sheet in a punching position temporarily, in receiving a command for performing the punching processing from the operation section that accepts operation of a user, described later.

The punching means 38 is provided with a punching mechanism 38*a* not shown for punching a punch hole in the sheet passing the sheet transport path inside the punch unit 30, and a dust box 39 for storing dust of the sheet subjected to punching by the punching mechanism 38*a*.

The configuration of the punching mechanism 38*a* will be described below, and is a general mechanism with a rotating eccentric cam and punching blade combined, and the description particularly using the drawing is omitted. A punching member having a punching blade (punch) and a die member having a blade receiving hole are disposed opposite each other via the sheet transport path inside the punch unit 30. The punch member is bearing-supported by a unit frame to be able to move up and down at a predetermined stroke, and is coupled to a punching drive means for moving up and down.

The punching drive means is comprised of a drive motor, and a drive cam coupled to the motor. The drive cam is comprised of an eccentric cam, and is link-coupled to the punching member. The driver of the drive motor of the punching drive means is connected to the control section not shown and is controlled. The punching mechanism 38*a* is comprised of a shift mechanism for causing one or a plurality of punching members to reciprocate from a top dead center to a bottom dead center at a predetermined stroke, and the mechanism is comprised of the drive cam, drive motor and the like. Alternatively, as the punching mechanism, it is also possible to adopt a mechanism (rotary punch mechanism) where a protrusion-shaped punch member is integrally formed around a rotating body, and a file hole is punched in the passing sheet by rotation of the rotating body.

[Relay Transport Unit]

The sheet passing through the sheet transport path inside the punch unit 30 passes a sheet transport path inside the relay transport unit 31, and is transported to the sheet binding unit 32. In the sheet transport path inside the relay transport unit 31, a first relay transport roller pair 34 and a second relay transport roller pair 35 are provided in substantially horizontal positions at a distance. A length between the first relay transport roller pair 34 and the second relay transport roller pair 35 is set at a length substantially equal to a length between the first main body discharge roller 14 and the first relay transport roller pair 34, and to a length between the second relay transport roller pair 35 and a carry-in roller 51 provided in the sheet binding unit 32 described later, and is set at a length shorter than a minimum sheet length in the sheet transport direction among various sheets used in the image forming unit A.

[Sheet Binding Unit]

Figure 2:
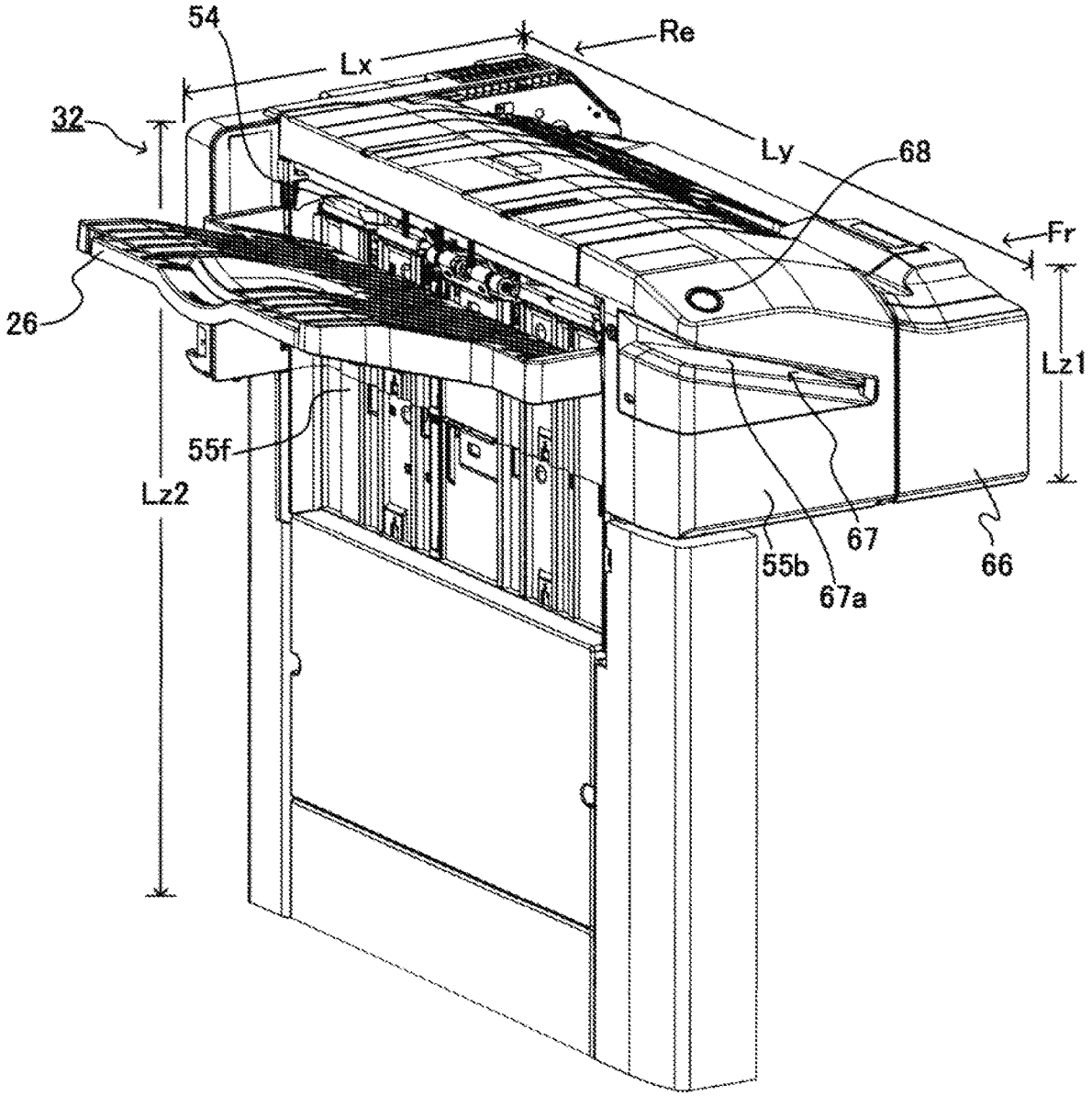
FIG. 2 is a perspective explanatory view illustrating the entire configuration of a sheet processing apparatus shown in FIG. 1.
Figure 3:
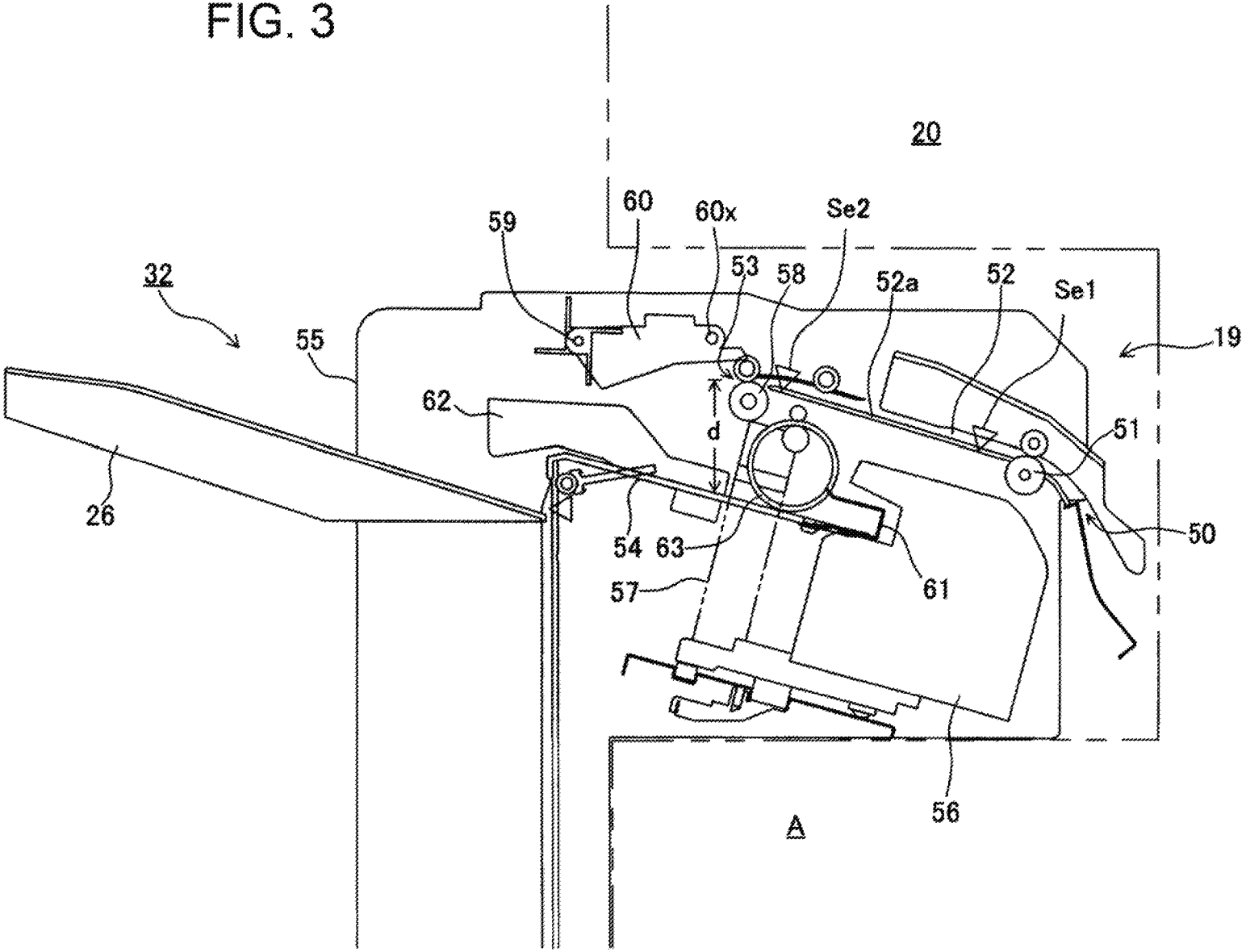
FIG. 3 is a side cross-sectional view of the apparatus of FIG. 2 (apparatus front side)

As shown in FIG. 3 illustrating the cross-sectional configuration of the configuration of the entire apparatus shown in the perspective view in FIG. 2, the sheet binding unit 32 is comprised of an apparatus housing 55, a sheet carry-in path 52 disposed inside the housing, a processing tray 54 disposed on the downstream side of the sheet carry-in path 52 in the sheet transport direction, and a first stack tray 26 disposed on the further downstream side.

In the processing tray 25 are disposed a sheet carry-in means 65 for carrying the sheet in, a sheet end regulation means 61 for stacking carried-sheets in the shape of a bunch, and a sheet alignment means 62 for tapping the sheets stacked in the shape of a bunch from the direction orthogonal to the sheet transport direction to align. Together with the means, in the processing tray 54 are disposed a staple binding means 56 (first binding means) for binding the aligned bunch of sheets with a staple, and a non-needle binding means 57 (second binding means) for binding the aligned bunch of sheets without using needles such as staples.

The apparatus housing 55 is comprised of an apparatus frame 55*a* and exterior casing 55*b*, and the apparatus frame 55*a* is comprised of a frame structure for supporting each mechanism section (path mechanism, tray mechanism, transport mechanism, etc.) described later. In the apparatus shown in the figure, a binding mechanism, transport mechanism, tray mechanism and drive mechanism are disposed between a pair of mutually opposed side frames (not shown), and the apparatus is comprised of a monocoque structure integrated by the exterior casing 55*b*. The exterior casing 55*b* is comprised of a monocoque structure where a pair of side frames 55*c*, 55*d*, and stay frame for coupling both the side frames are integrated by mold processing with resin and the like, and a part thereof (apparatus front side) is exposed to enable operation to be performed from outside.

The sheet binding unit 32 is configured as described above. In other words, the outer region of the frame is covered with the exterior casing 55*a*, and the first stack tray 26, guide portions disposed around the first stack tray 26, and the sheet binding mechanism section except the drive section are incorporated into the sheet discharge space 19 of the image forming unit A. In this state, a part of the apparatus front side Fr of the exterior casing 55*b* is also exposed to be a state for enabling operation to be performed from outside. The apparatus front side Fr of the exterior casing 55*b* is equipped with a staple replacement cover 66, manual set portion (insertion portion), and a manual operation button 68 (in the figure, switch with an integral display lamp), described later.

In the exterior casing 55*a*, a length dimension Lx in the transport direction of the sheet, and a length Ly in the direction orthogonal to the transport direction are configured with respect to the maximum-size sheet capable of being processed in the sheet binding unit 32 as reference, and are set at a dimension smaller than the sheet discharge space 19 of the image forming unit A. Further, as a length dimension Lz in the up-and-down direction (gravity direction) in installing the apparatus, a portion (length dimension Lz1) where a processing section of the staple binding means 56, non-needle binding means 57 and the like described later is disposed is set at a dimension smaller than the sheet discharge space 19 of the image forming unit A, and a portion (length dimension Lz2) where the first stack tray 26, guide portions disposed around the first stack tray 26, and the drive section are disposed is set at a sheet stack amount of the first stack tray 26 i.e. a shift amount of the first stack tray 26 configured by a sheet stack maximum amount.

[Sheet Transport Path]

As shown in FIG. 3, in the apparatus housing 55 is disposed the sheet carry-in path 52 having a carry-in entrance 50, and the path 52 shown in the figure is configured to receive a sheet in the horizontal direction from the relay transport unit 31, and transports substantially in the horizontal direction (direction slightly tilted upward in the sheet transport direction) to carry out from the sheet discharge outlet 53. The sheet carry-in path 52 is formed of an appropriate paper guide (plate) 52*a*, and the transport mechanism for transporting the sheet is incorporated. The transport mechanism is comprised of transport roller pairs at predetermined intervals corresponding to the path length, and in the mechanism shown in the figure, the carry-in roller 51 and sheet discharge roller 58 are disposed near the carry-in entrance 50 and sheet discharge outlet 53, respectively. Further, in the sheet carry-in path 52 are disposed sheet sensors Se1, Se2 for detecting the front end and/or rear end of the sheet.

The sheet carry-in path 52 is formed of a linear path substantially in the horizontal direction so as to traverse the apparatus housing 55. This is because of avoiding stress imposed on a sheet by a curved path, and the path is formed with linearity allowed by apparatus layout. The above-mentioned carry-roller 51 and sheet discharge roller 58 are coupled to the same drive motor M1 (hereinafter, referred to as "transport motor") not shown, and transport the sheet at the same circumferential velocity.

[Processing Tray]

The description will be given according to FIG. 3. In the sheet discharge outlet 53 of the sheet carry-in path 52, a height difference d is formed on the downstream side of the outlet in the sheet transport direction, and the processing tray 54 is disposed. The processing tray 54 is provided with a paper mount surface 54*a* for supporting at least a part of the sheet, in order to stack sheets fed from the sheet discharge outlet 53 upward to collect in the shape of a bunch. The apparatus shown in the figure adopts a structure (bridge support structure) where the first stack tray 26 described later supports the sheet front end side, and the processing tray 54 supports the sheet rear end side. By this means, the tray dimensions are reduced.

The processing tray 54 is configured to collect sheets fed from the sheet discharge outlet 53 in the shape of a bunch, perform the binding processing after aligning in a predetermined posture, and carry the processed bunch of sheets out to the first stack tray 26 on the downstream side in the sheet transport direction. Therefore, into the processing tray 54 are incorporated the "sheet carry-in means 65", "sheet alignment means 62", "staple binding means 56", "non-needle binding means 57" and "sheet bunch carrying-out means 70".

[Sheet Carry-In Means]

In the above-mentioned sheet discharge outlet 53, the processing tray 54 is disposed with the height difference d formed. The sheet carry-in means 65 is required to smoothly transport the sheet onto the processing tray 54 in a proper posture. The sheet carry-in means 65 (friction rotating body) shown in the figure is comprised of paddle rotating bodies 59 moving up and down, and in a stage in which the sheet rear end is carried out onto the tray from the sheet discharge outlet 53, the paddle rotating bodies 59 carry the sheet in the direction (direction from the left to the right in FIG. 3) opposite to the direction for discharging the sheet, and strike by the sheet end regulation means 61 described later to align (position).

Therefore, the sheet discharge outlet 53 is provided with an up-and-down arm 60 axially supported by the apparatus frame 55*a* with a spindle 60*x* to be swingable, and the paddle rotating bodies 59 are axially supported by the front end portion of the up-and-down arm 60 to be rotatable. The spindle 60*x* is equipped with a pulley not shown, and the pulley is coupled to the transport motor M1 described previously.

Concurrently therewith, the up-and-down arm 60 is coupled to an up-and-down motor M3 (hereinafter, referred to as "paddle up-and-down motor") via a spring clutch (torque limiter), and it is configured that the up-and-down arm 60 is moved up and down between an upper waiting position Wp and a lower actuation position Ap (engagement position with the sheet) by rotation of the paddle up-and-down motor M3. In other words, the spring clutch is to move the up-and-down arm 60 up from the actuation position Ap to the waiting position Wp by rotation in one direction of the paddle up-and-down motor M3, and after striking a lock stopper not shown, wait in the waiting position Wp. Further, the spring clutch is relaxed by rotation in the opposite direction of the paddle up-and-down motor M3, and the up-and-down arm 60 moves down from the waiting position Wp to the lower actuation position Ap under its own weight, and engages in the sheet in the uppermost position stacked on the processing tray 54.

Figure 5:
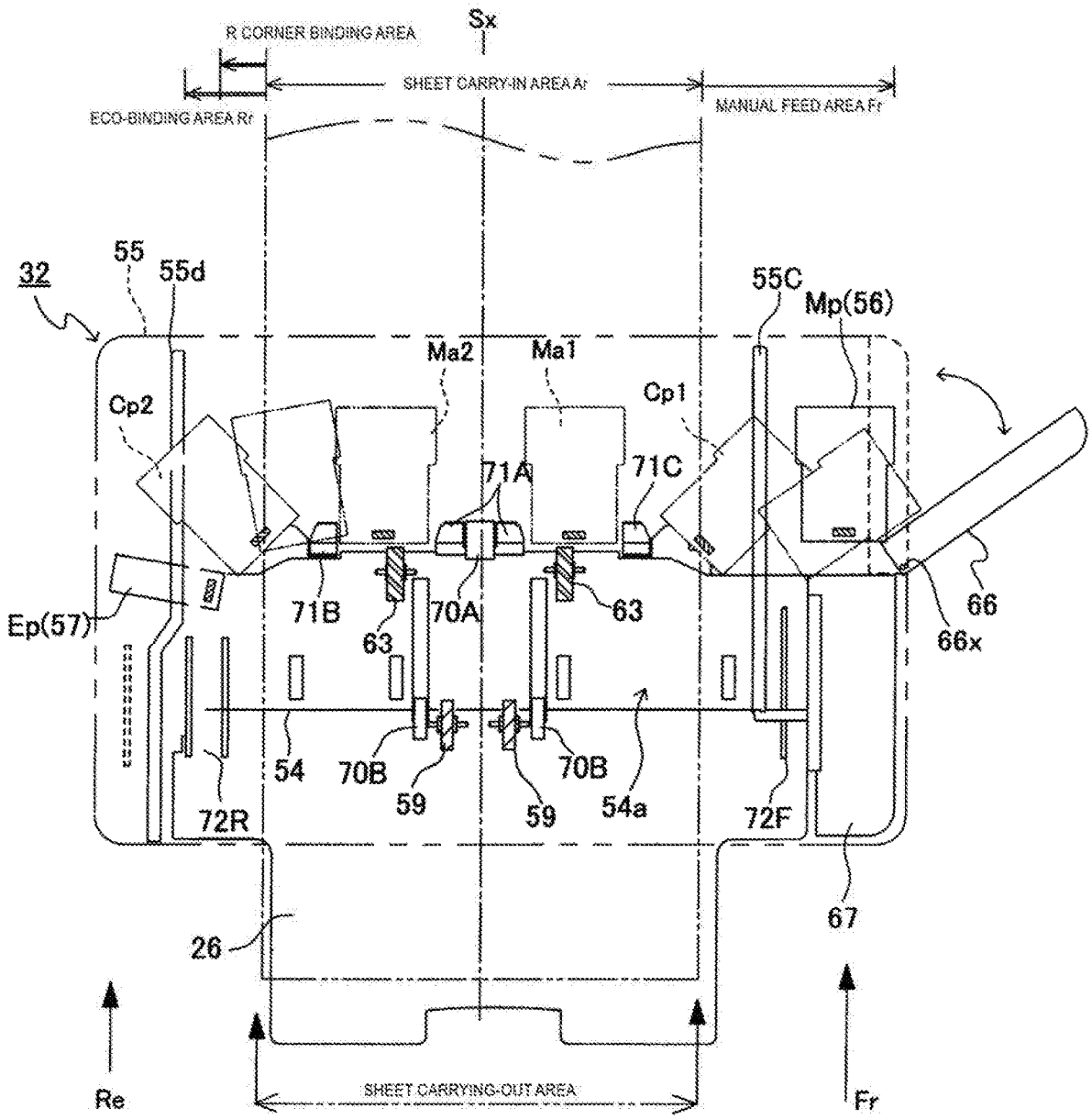
FIG. 5 is an explanatory view illustrating an arrangement relationship between each area and an alignment position in the apparatus of FIG. 2.

In the apparatus shown in the figure, as shown in FIG. 5, the paddle rotating bodies 59 are spaced a predetermined distance apart from each other with the sheet center (center reference Sx) as reference, and are disposed bilaterally symmetrically as a pair. As well as the bodies 59, total three paddle rotating bodies may be disposed in the sheet center and opposite sides, or one paddle rotating body may be disposed in the sheet center.

The paddle rotating body 59 is comprised of a flexible rotating body such as a rubber plate-shaped member and a wing member made of plastic. As well as the paddle rotating body, the sheet carry-in means 65 is capable of being comprised of a rotating member having proper friction on its surface such as a roller body and a belt body. Further, the apparatus shown in the figure illustrates the mechanism for moving the paddle rotating bodies 59 down from the upper waiting position Wp to the lower actuation position Ap, after carrying the rear end of the sheet out of the sheet discharge outlet 53, and it is also possible to adopt the following up-and-down control.

For example, in a stage in which the front end of the sheet is carried out of the sheet discharge outlet 53, the friction rotating body is moved down from the waiting position to the actuation position, and concurrently, is rotated in accordance with the direction in which the sheet is carried out. Then, at timing at which the rear end of the sheet is carried out of the sheet discharge outlet 53, the friction rotating body is rotated in the direction opposite to the carrying-out direction. By this means, it is possible to carry the sheet, which is carried out of the sheet discharge outlet 53, to a predetermined position of the processing tray 54 at a high speed without skewing.

In the case of transporting the sheet to a predetermined position of the processing tray 54 with the sheet carry-in means 65 (paddle rotating body) disposed in the above-mentioned sheet discharge outlet 53, a take-in transport means 63 is required to reliably guide the sheet front end of the curled sheet, skewed sheet or the like to the sheet end regulation means 61.

In the apparatus shown in the figure is disposed take-in rotating bodies (take-in transport means) 63 which transport, toward the sheet end regulation means 61 side, the uppermost sheet of sheets stacked on the upstream side of the sheet end regulation means 61, described later, below the sheet discharge roller 58. In the means shown in the figure, a ring-shaped belt member 69 (hereinafter, referred to as "take-in belt") is disposed in a position opposed to the sheet carry-in means 65 with the sheet discharge roller 58 of the processing tray 54 therebetween. The take-in belt 69 engages in the uppermost sheet on the processing tray 54, while rotating in the direction for transporting the sheet to the sheet end regulation means 61 side.

Therefore, the take-in belt 69 is comprised of a belt member (knurled belt, etc.) with high friction force made of flexible materials such as rubber materials, and is sandwiched and supported between a rotating shaft 69*y* coupled to the drive motor (common to the transport motor M1 in the apparatus shown in the figure) and an idle shaft 69*y*. Then, the rotation force in a counterclockwise direction viewed in FIG. 3 is given from the rotating shaft 69*x*. Concurrently therewith, the take-in belt 69 causes the front end of the sheet to strike the sheet end regulation means 61, while pressing the sheet which is carried in along the uppermost sheet stacked on the processing tray 54.

The take-in belt 69 is configured to move up and down to above the uppermost sheet on the processing tray 54 with a belt shift motor M5 (hereinafter, referred to as "knurled up-and-down motor") (the description of the up-and-down mechanism thereof is omitted). Then, at timing at which the front end of the sheet enters between the belt surface and the uppermost sheet, the take-in belt 69 moves down to engage in the sheet. Further, when the sheet bunch carrying-out means 70 described later carries to the first stack tray 26 from the processing tray 54, the knurled up-and-down motor M5 is controlled so that the take-in belt 69 separates from the uppermost sheet and waits above.

[Sheet Alignment Mechanism]

In the processing tray 54, the sheet alignment mechanism is disposed to position the carried-sheet in a predetermined position (processing position). The sheet alignment mechanism shown in the figure is comprised of the "sheet end regulation means 61" for regulating the position of the end face (front end or rear end) in the sheet transport direction of the sheet carried out of the sheet discharge outlet 53, and the "sheet alignment means 62" for aligning the width in the direction (sheet side direction) orthogonal to the direction for transporting the sheet. The means will be described below in this order.

The sheet end regulation means 61 shown in the figure is comprised of rear end regulation members 71 which strike the rear end of the sheet in the discharge direction to regulate. The rear end regulation member 71 is provided with a regulation surface 71*a* which strikes the rear end edge in the sheet discharge direction of the sheet carried in along the paper mount surface 54*a* on the processing tray 54 to regulate, and strikes the rear end in the sheet discharge direction of the sheet fed by the take-in transport means 63 described previously to halt.

The rear end regulation member 71 is configured not to interfere with a shift (shift in the direction orthogonal to the sheet discharge direction) of a stapler unit, in performing multi-binding with the staple binding means 56 described later. As an example, there are (1) a mechanism for causing the rear end regulation member 71 to enter and retract with respect to a shift path (shift locus) of the staple binding means 56, (2) another mechanism for shifting in position integrally with the staple binding means 56, and (3) still another mechanism where the rear end regulation member 71 is comprised of a channel-shaped bent piece inside binding space comprised of a head and an anvil of the staple binding means 56.

The member shown in the figure adopts the configuration described in the above-mentioned third configuration, and the rear end regulation member 71 is comprised of a plate-shaped bent member in the shape of a C (channel shape) in cross section disposed inside binding space of the staple binding means 56. Then, with respect to the minimum-size sheet as reference, a first rear end regulation member 71A is disposed in the sheet center, and second and third rear end regulation members 71B and 71C are disposed on opposite sides of the member 71A, while being spaced a distance apart from the member 71A (see FIG. 5). By this means, the staple binding means 56 is allowed to shift in the direction orthogonal to the sheet discharge direction of the sheet.

On the processing tray 54, the sheet alignment means 62 is provided to position the sheet striking the above-mentioned rear end regulation member 71 in a direction (hereinafter, referred to as "sheet width direction") orthogonal to the sheet discharge direction of the sheet. The configuration of the sheet alignment means 62 differs corresponding to whether to align sheets of different sizes on the processing tray 54 in the center reference or one-side reference.

In the apparatus shown in FIG. 5, sheets of different sizes are discharged in the center reference from the sheet discharge outlet 53, and these sheets are aligned in the center of the sheet as reference on the processing tray 54. Then, the binding processing is performed on a bunch of the sheets aligned in the shape of the bunch in the center reference. Further, corresponding to selection of the binding processing, in multi-binding for performing the binding processing in a plurality of portions of the sheet, the staple binding means 56 performs the binding processing in binding positions Ma1, Ma2 in the position in which alignment is performed with the center as reference. In corner binding for performing the binding processing near a corner portion in the sheet width direction, the bunch of sheets is offset and shifted to one direction in the sheet width direction by a predetermined amount, and the means 56 performs the binding processing in corner positions Cp1, Cp2.

To perform such an alignment operation, in the sheet alignment means 62, side alignment members 72 (72F, 72R), each of which protrudes above from the paper mount surface 54*a* of the processing tray 54 and has an regulation surface 72*x* to engage in a side edge in the sheet width direction of the sheet, are disposed opposite each other in the sheet width direction as a pair. Then, the pair of side alignment members 72 is disposed in the processing tray 54 to be able to reciprocate at a predetermined stroke. An amount of this stroke is set according to a size difference between the sheet of the maximum size and the sheet of the minimum size processed in the sheet post-processing unit B, and an offset amount by which the bunch of aligned sheets is offset and shifted to one direction in the sheet width direction. In other words, the stroke amount by which the side alignment members 72F, 72R are capable of shifting is set corresponding to the shift amount to align sheets of different sizes, and the amount by which the bunch of aligned sheets is offset and shifted.

Figure 6:
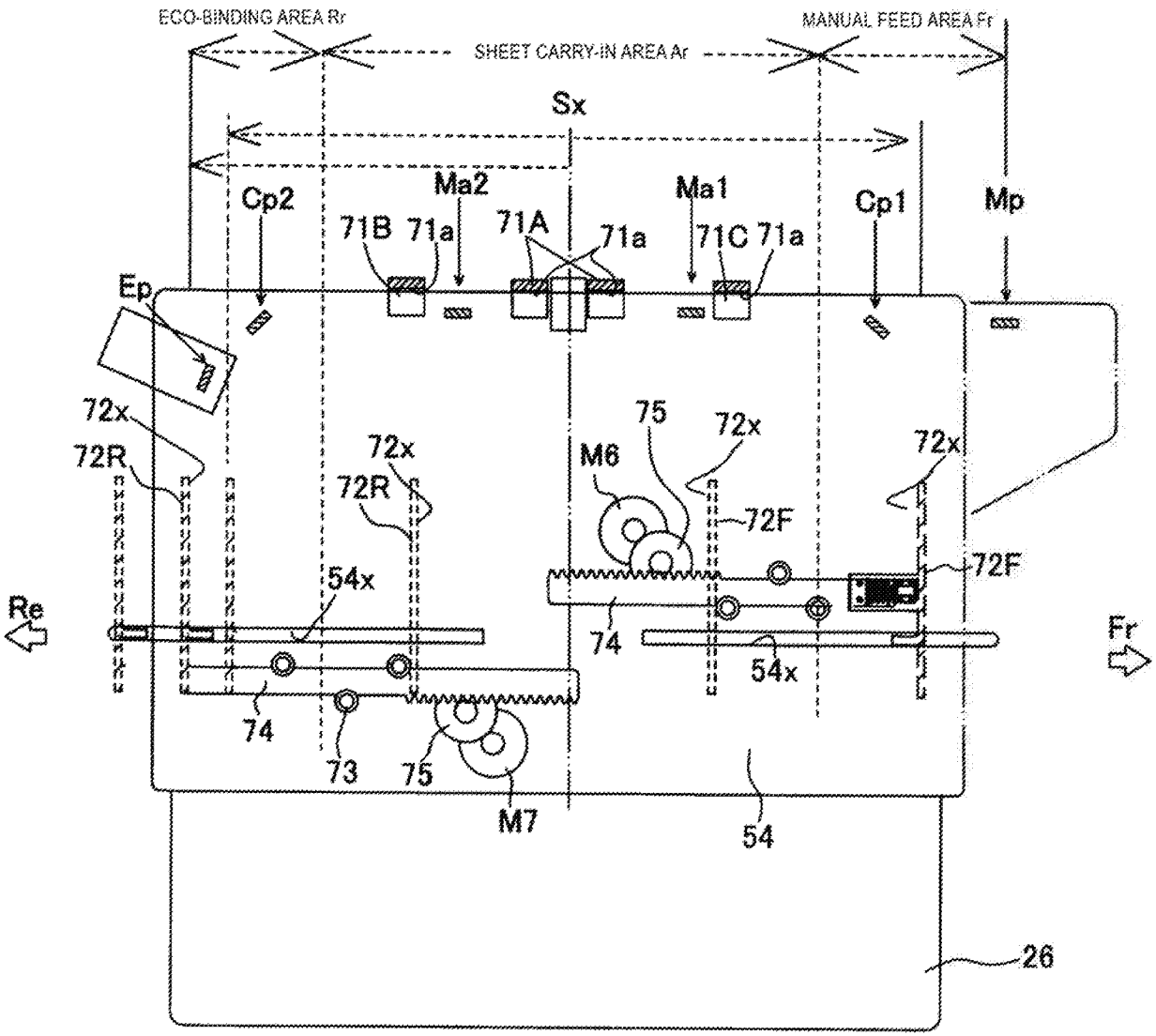
FIG. 6 is a configuration explanatory view of side alignment members in the apparatus of FIG. 2.

Therefore, as shown in FIG. 6, the side alignment members 72 are comprised of the front-side side alignment member 72R and the rear-side side alignment member 72L, and two side alignment members 72 are attached and supported to/by the processing tray 54 so that the regulation surfaces 72*x* for engaging in side edges in the sheet width direction of the sheet shift mutually in the approach direction or separate direction. Slit grooves 54*x* for penetrating from the frontside to the backside are provided in the processing tray 54, and into the slit grove is fitted the side alignment member 72 having the regulation surface 72*x* for engaging in the side edge in the sheet width direction on the top surface of the processing tray 54.

Each of the side alignment members 72F, 72R is supported slidably by a plurality of guide rollers 73 (which may be a rail member) on the back side of the processing tray 54, and racks 74 are integrally formed. The racks 74 on both of the front side and the rear side are coupled to alignment motors M6, M7 via pinions 75. These two alignment motors M6, M7 are comprised of stepping motors, and are configured to detect positions of two side alignment members 72F, 72R with position detection sensors not shown, and with the detection values as reference, shift positions of respective side alignment members by designated shift amounts in both the front direction and the rear direction.

In addition, instead of the rack & pinion mechanism shown in the figure, it is possible to adopt a configuration where each of the side alignment members 72F, 72R is fixed to a belt, and the belt is coupled to a motor for causing the member to reciprocate in the front and rear directions with a pulley.

In such a configuration, the control section not shown causes two side alignment members 72 to wait in predetermined waiting positions (width of the sheet+α position) based on size information of the sheets provided from the image forming unit A. In this state, the sheet is carried onto the processing tray 54, and at timing at which the rear end of the sheet in the discharge direction strikes the rear end regulation member 71, alignment operation is started. This alignment operation is to rotate two alignment motors M6, M7 by the same amount in the direction in which two side alignment members 72 approach. Then, the sheet carried onto the processing tray 54 is positioned with the sheet center as reference and is stacked in the shape of a bunch. By repeating the sheet carry-in operation and alignment operation, sheets are collated and collected in the shape of a bunch on the processing tray 54.

In the sheets collected on the processing tray 54 in the center reference as described above, it is possible to perform the so-called multi-binding processing for performing the binding processing in a plurality of portions at predetermined intervals in the rear end or the front end of sheets in an aligned posture. Further, in the case of performing the so-called corner binding processing for binding a portion near the corner portion of the sheets, one of two side alignment members 72 is shifted and halted in a position in which the designated binding position coincides with the side edge in the sheet width direction of the sheet. Then, the remaining other side alignment member 72 is shifted to a position in the direction for approaching the side alignment member 72 first shifted. A shift amount in the approach direction is calculated corresponding to the sheet size. By this means, the sheet carried onto the processing tray 54 is aligned so that the front side edge in the sheet width direction of the sheet coincides with the binding position in performing processing for corner binding on the front side of the sheet, and is aligned so that the rear side edge in the sheet width direction of the sheet coincides with the binding position in performing processing for corner binding on the rear side.

[Binding Means]

As described above, the sheet carried out of the sheet discharge outlet 53 of the sheet carry-in path 52 is collated and stacked on the processing tray 54, and is aligned in beforehand set position and posture by the sheet end regulation means 61 and sheet alignment means 62. Subsequently, a bunch of aligned sheets is subjected to the binding processing, and is carried out to the first stack tray 26 positioned on the downstream side in the sheet discharge direction of the sheet. The binding processing will be described below.

As the mechanism of the binding processing, the sheet binding unit 32 provides the processing tray 54 with the "staple binding means 56 (hereinafter referred to as "first binding means") for performing the binding processing on a bunch of sheets using needles such as staples", and the "non-needle binding means 57 (hereinafter referred to as "second binding means") for pressing and deforming a bunch of sheets to perform the binding processing without using needles and the like". When a bunch of sheets is subjected to the binding processing with staples and the like, it is possible to perform bookbinding binding hard to remove, but there is the case where convenience for easily separating a bunch of bound sheets is required according to a use of a user. Further, when the used bunch of sheets is cut with a shredder and the like, the metal needle becomes the problem, and therefore, it is suitable for a user that it is possible to select the "with needle" or "without needle" binding means to use.

Further, as well as a series of processing operation for performing the binding processing after carrying out sheets from the sheet carry-in path 52 to collate and stack, the sheet binding unit 32 is also capable of performing the binding processing on a bunch of sheets which is prepared outside the image forming apparatus or is discharged without selecting the binding processing. Therefore, a manual set section 67 is disposed in the exterior casing 55*b* to set a bunch of sheets from outside, a manual set surface 67*a* to set a bunch of sheets is formed in the exterior casing 55*b*, and the first binding means 56 described previously is configured to shift in position from a sheet carry-in area Ar of the processing tray 54 to a manual feed area Fr. As shown in FIG. 2, the manual set surface 67*a* formed in the exterior casing 55*b* is disposed in the corner on the front side of the apparatus astride from inside the body to outside the body of the image forming apparatus.

As shown in FIG. 5, the sheet binding unit 32 is set for "multi-binding positions Ma1, Ma2" for performing the binding processing in a plurality of portions of the sheets with staples, "corner binding positions Cp1, Cp2" for performing the binding processing in the corner of the sheet, "manual binding position Mp" for performing the binding processing on sheets set on the manual set surface 67*a*, and "non-needle binding position Ep" for performing the binding processing in the corner of the sheets without using staples. In the apparatus, the first binding means performs the binding processing of multi-binding, corner binding and manual binding, and the second binding means performs the binding processing of non-needle binding.

The "multi-binding processing" will be described first. In FIG. 5, the multi-binding processing is to perform the binding processing in the rear end in the sheet discharge direction of a bunch of sheets (hereinafter, referred to as "aligned sheet bunch") which is aligned and positioned on the processing tray 54 by the sheet end regulation means 61 and sheet alignment means 62. In FIG. 5, the binding positions Ma1, Ma2 spaced a distance apart are set to perform the binding processing in two portions. The first binding means 56 shifts from a predetermined waiting position (home position) to the binding position Ma1, and then to Ma2 in this order, and performs the binding processing in each position. In addition, the multi-position binding position is not limited to two portions, and it is possible set the binding processing position in three portions, or more positions.

The "corner binding processing" is set for the binding position in two portions of first corner binding position Cp1 for performing the binding processing in the corner on the apparatus front side of the aligned sheet bunch collected on the processing tray 54, and second corner binding position Cp2 for performing the binding processing in the corner on the apparatus rear side of the aligned sheet bunch. In the case of performing the corner binding, the first binding means is inclined a predetermined angle (about 30° to 60°) with respect to the sheet end edge to perform the binding processing. The staple subjected to the binding processing is inclined a predetermined angle with respect to the sheet end edge to bind the aligned sheet bunch.

The specification of the apparatus shown in the figure illustrates the case where the binding processing is performed by selecting one of the front side and rear side of the aligned sheet bunch, and the case of inclining the staple a predetermined angle to perform the binding processing. The invention is not limited thereto, and it is possible to also adopt a configuration for performing the binding processing on only one of the front side and rear side of the aligned sheet bunch, and a configuration for binding parallel with one end edge of a long side or short side, without including the staple a predetermined angle with respect to the sheet end edge.

The manual binding position Mp to perform "manual binding processing" is positioned in the manual set surface 67*a* formed in the exterior casing 55*b*. The manual set surface 67*a* has a height for forming almost the same plane as the paper mount surface 54*a* of the processing tray 54, and is disposed parallel in a position adjacent to the paper mount surface 54*a* via the side frame 55*c*. In the apparatus shown in the figure, both of the paper mount surface 54*a* and manual set surface 67*a* support the sheet substantially in the horizontal posture, and are disposed substantially at the same height.

In other words, in FIG. 5, via the side frame 55*c*, the manual set surface 67*a* is disposed on the front side, and the paper mount surface 54*a* is disposed on the rear side. Then, the manual binding position Mp is arranged in line with the multi-binding position Ma, described previously, disposed in the paper mount surface 54*a*. This is because of performing both of the binding processing with the common staple binding means 56. Accordingly, in the processing tray 54 are disposed the sheet carry-in area Ar, the manual feed area Fr on the apparatus front side, and a non-needle binding (eco-binding) area Rr on the apparatus rear side.

As shown in FIG. 5, in the "non-needle binding processing", the processing is performed in the non-needle binding position Ep (hereinafter, referred to as "eco-binding position") disposed on the apparatus rear side so as to perform the binding processing in a portion (corner) near the corner of the sheet. The eco-binding position Ep shown in the figure is disposed in a position to perform the binding processing in the corner on the rear side in the rear end in the sheet discharge direction of the aligned sheet bunch, and the binding processing is performed in an angle position inclined a predetermined angle with respect to the sheet end edge. Then, the eco-binding position Ep is disposed in the eco-binding area Rr spaced apart from the sheet carry-in area Ar of the processing tray 54 toward the apparatus rear side.

In regard to configurations and control of the staple binding means 56 and non-needle binding means 57, mechanisms of the stapler unit and press binder unit are known in Japanese Unexamined Patent Publication No. 2015-16970. The staple binding means 56 and non-needle binding means 57 of the invention of the present Description adopt the same configuration and control, and therefore, detailed descriptions are not given.

[Sheet Bunch Carrying-Out Means]

The sheet bunch carrying-out means shown in FIGS. 7A to 7D will be described. In the above-mentioned processing tray 54 is disposed a sheet bunch carrying-out mechanism for carrying out a bunch of sheets subjected to the binding processing with the first binding means 56 or the second binding means 57 to the first stack tray 26 disposed on the downstream side in the discharge direction of the sheet. In the processing tray 54 described according to FIG. 5, the first rear end regulation member 71A is disposed in the sheet center Sx, and the second and third rear end regulation members 71B, 71C spaced a distance are disposed on opposite sides of the member 71A in the sheet width direction. Then, it is configured that a bunch of sheets locked by the rear end regulation member 71 is subjected to the binding processing with the first binding means 56 or second binding means 57, and then, is carried out to the first stack tray 26 on the downstream side in the discharge direction of the sheet.

Therefore, in the processing tray 54, the sheet bunch carrying-out means 70 is disposed along the paper mount surface 54*a*. The sheet bunch carrying-out means 70 shown in the figure is comprised of a first bunch transport member 70A and second bunch transport member 70B, the first bunch transport member 70A performs relay-transport in a first zone Tr1 on the processing tray 54, and the second bunch transport member 70B performs relay-transport in a second zone Tr2. By thus relay-transporting the sheet by the first bunch transport member 70A and second bunch transport member 70B, it is possible to make the mechanism of each carrying-out member a different structure. Then, it is necessary that the first bunch transport member 70A for transporting a bunch of sheets from almost the same starting point as the sheet end regulation means 61 is comprised of a member (long support member) with few variation, and that the second bunch transport member 70B for dropping the bunch of sheets into the first stack tray 26 at a transport endpoint is configured to be small so as to shift along a loop-shaped locus.

The first bunch transport member 70A is comprised of a first carrying-out member 76 formed of a bent piece in the shape of a channel in cross section, and this member is provided with a lock surface 76 for locking the rear end edge of a bunch of sheets in the sheet discharge direction, and a paper surface pressing member 78 formed of an elastic film material and the like to press the top surface of the sheets locked by the surface 76. As shown in the figure, since the first carrying-out member 76 is comprised of the channel-shaped bent piece, when the member 76 is fixed to a carrier member 79 comprised of a belt described later, the member shakes little, travels integrally with the belt, and feeds the rear end of the bunch of sheets in the discharge direction of the sheet. Then, the first carrying-out member 76 does not travel the curved loop-shaped locus as described later, and reciprocates in a zone of Str1 shown in FIG. 7A with almost a linear locus.

The second bunch transport member 70B is comprised of a claw-shaped second carrying-out member 77, and is provided with a lock surface 77*a* for locking the rear end edge of a bunch of sheets in the discharge direction, and a paper surface pressing member 80 for pressing the top surface of the bunch of sheets. The paper surface pressing member 80 is axially supported by the second carrying-out member 77 to be swingable, and is provided with a paper surface pressing surface 80*a*, and the paper surface pressing surface is biased by a biasing spring 80*b* that works a biasing force so as to press the top surface of the bunch of sheets.

Figure 7A:
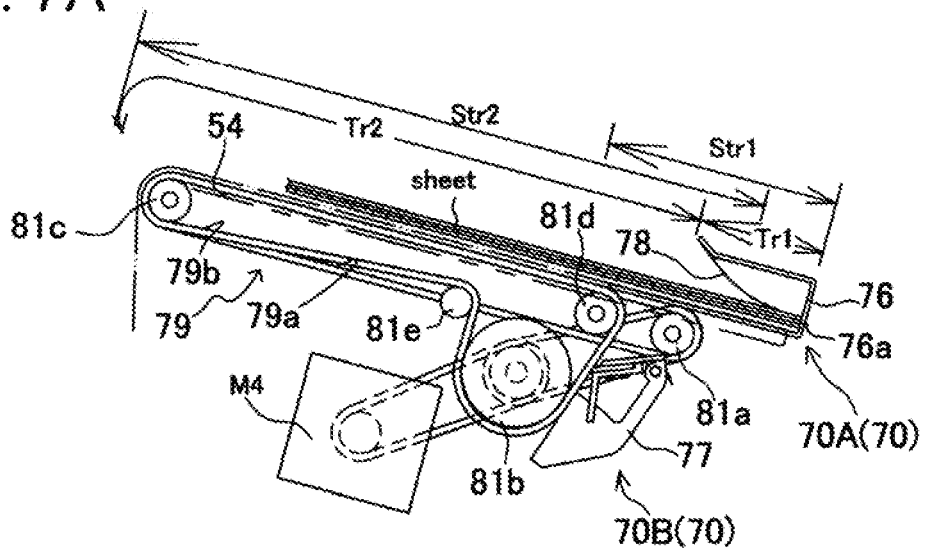
FIGS. 7A to 7D contain explanatory views of a sheet bunch carrying-out means in the apparatus of FIG. 2, where
Figure 7B:
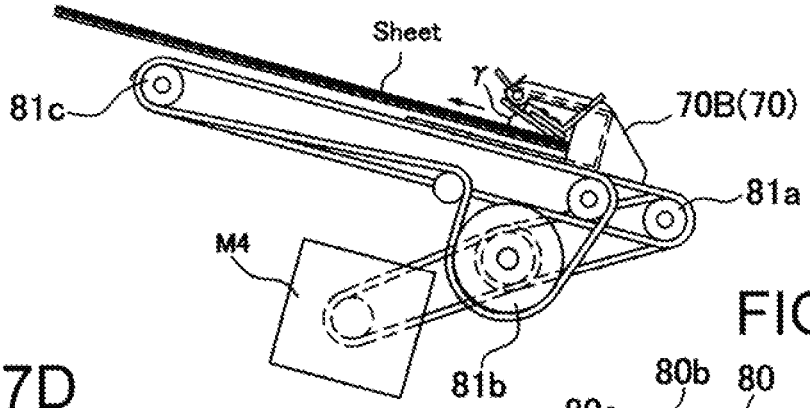
Figure 7C:
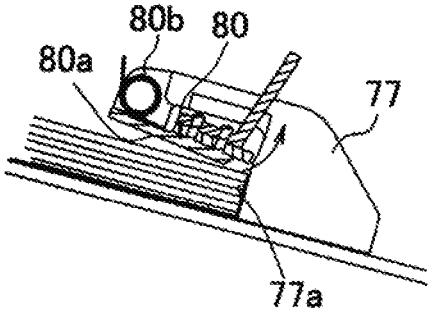
Figure 7D:
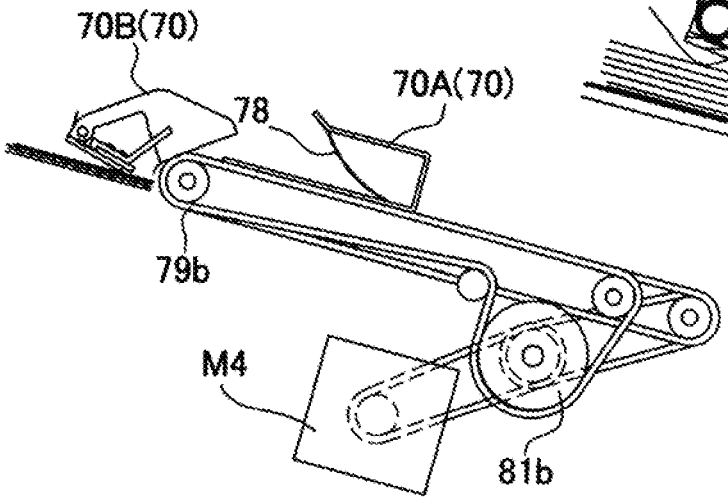

Further, as shown in the figure, the paper surface pressing surface 80*a* is comprised of an inclined surface inclined with respect to the direction in which the second carrying-out member 77 travels, and in shifting in direction shown by the arrow in FIG. 7B, engages in the rear end of the sheet at a nip angle γ. At this point, the paper surface pressing surface 80*a* deforms in the counterclockwise direction viewed in FIG. 7B against the biasing spring 80*b*. Then, as shown in FIG. 7C, by the action of the biasing spring 80*b*, the paper surface pressing surface 80*a* presses the top surface of the bunch of sheets to the paper mount surface 54*b* side.

As in the first carrying-out member 76, the second carrying-out member 77 is fixed to the carrier member 79 comprised of a belt, travels integrally with the belt, and feeds the rear end of the bunch of sheets in the discharge direction of the sheet. The first carrying-out member 76 and second carrying-out member 77 reciprocate from a base end portion of the paper mount surface 54*a* to an end portion (hereinafter, referred to as "exit end portion") on the downstream direction of the processing tray 54 in the discharge direction by a first carrier member 79*a* and second carrier member 79*b*, respectively. Therefore, in the paper mount surface 54*a*, drive pulleys 81*a*, 81*b* and driven pulley 81*c* are disposed in positions spaced a transport stroke. Notation of 81*d*, 81*e* shown in the figure is idle pulleys.

Then, the first carrier member 79*a* (the member shown in the figure is a belt with teeth) is looped between the drive pulley 81*a* and the driven pulley 81*c*, and the second carrier member 79*b* (belt with teeth) is looped between the drive pulley 81*b* and the driven pulley 81*c* via the idle pulleys 81*d*, 81*e*. The drive pulleys 81*a*, 81*b* are coupled to a drive motor M4. Then, in order to convey drive rotation of the motor to the first carrier member 79*a* at a low velocity, and to the second carrier member 79*b* at a high velocity, the drive pulley 81*a* is formed to be a small diameter, and the drive pulley 81*b* is formed to be a large diameter.

In other words, the first bunch transport member 70A and second bunch transport member 70B are coupled to the common drive motor M4 via a reduction mechanism of the belt, pulley, gear coupling and the like, so that the member 70A travels at a low velocity, and that the member 70B travels at a high velocity. Concurrently therewith, a cam mechanism to delay transfer of the drive is incorporated into the drive pulley 81*b*. This is because the stroke range Str1 in which the first bunch transport member 70A travels is different from a stroke range Str2 in which the second bunch transport member 70B travels described later, and is because of adjusting the position of the waiting position of each member.

In the configuration as described above, the first bunch transport member 70A reciprocates in the stroke range Str1 with the linear locus from the position in which the rear end regulation member 71 of the processing tray 54 is disposed. Within the stroke range Str1, the first zone Tr1 is configured where only the first bunch transport member 70A transports the bunch of sheets. Further, the second bunch transport member 70B reciprocates in the stroke range Str2 with a half-loop-shaped locus between some midpoint of the first zone Tr1 and the exit end portion of the processing tray 54. Within the stroke range Str2, the second zone Tr2 is configured where only the second bunch transport member 70B transports the bunch of sheets.

Then, by rotation in one direction of the drive motor M4, the first bunch transport member 70A shifts from the position of the rear end regulation member 71 at a velocity V1 in the discharge direction of the sheet, and presses the rear end of the bunch of sheets in the discharge direction by the lock surface 76*a* thereof to transport. After a delay of predetermined time from the first bunch transport member 70A, the second bunch transport member 70B protrudes above the paper mount surface 54*a* from the waiting position on the back side of the processing tray 54, follows the first bunch transport member 70A, and shifts at a velocity V2 in the discharge direction of the sheet. At this point, since the reduction mechanism described previously is configured so that the velocity V1<V2, transport of the bunch of sheets on the processing tray 54 is relayed from the first bunch transport member 70A to the second bunch transport member 70B at some midpoint in the first zone Tr1.

FIG. 7B illustrates a state in which transport is relayed, and the second bunch transport member 70B shifting at the velocity V2 catches up with the bunch of sheets transported at the velocity V1. In other words, after passing through the first zone Tr1, the first bunch transport member 70A is caught up by the second bunch transport member 70B, and the second bunch transport member 70B engages in the rear end of the bunch of sheets in the discharge direction, and transports in the second zone Tr2. Then, the second bunch transport member 70B holds the rear end of the bunch of sheets to carry out toward the first stack tray 26.

[First Stack Tray]

Figure 8:
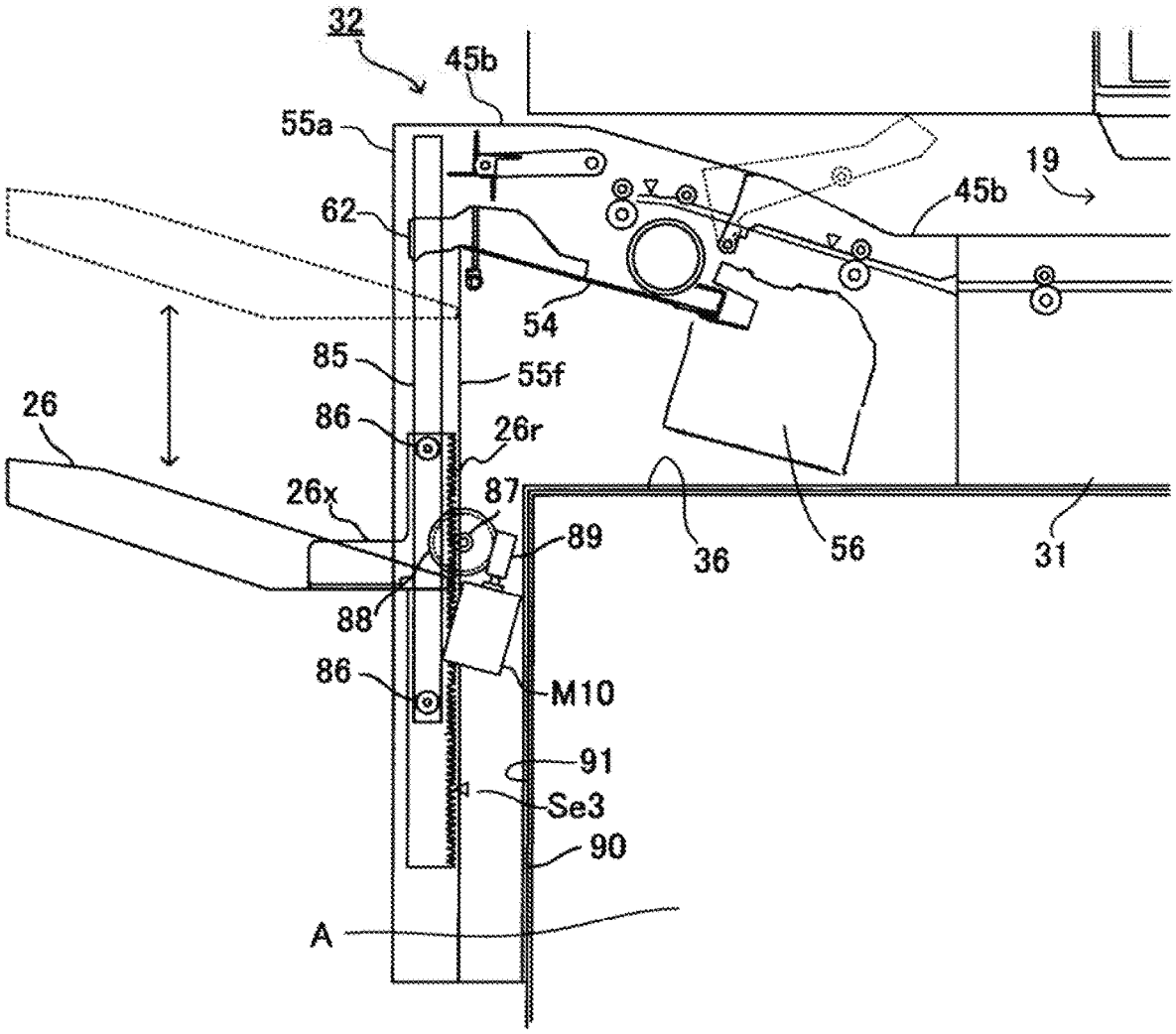
FIG. 8 is a configuration explanatory view of the first stack tray in the apparatus of FIG. 2.

A configuration of the first stack tray 26 will be described according to FIG. 8. The first stack tray 26 is disposed on the downstream side of the processing tray 54 in the sheet discharge direction, and stacks a bunch of sheets processed in the processing tray 54 to store. The tray is provided with a mechanism for moving the tray up and down to sequentially lower corresponding to a stack amount stacked on the first stack tray 26. A stack surface (uppermost sheet height) of the first stack tray 26 is capable of being moved up to a height position to be substantially the same plane as the paper mount surface 54*a* of the processing tray 54.

The mechanism for moving the first stack tray 26 up and down will be described specifically. An up-and-down rail 85 is fixed to the apparatus frame 55*a* in a stacking direction (up-and-down direction) of a bunch of sheets. An end portion of the first stack tray 26 on the downstream side in the sheet discharge direction is fixed to a tray base 26*x*. In the tray base 26*x*, slide rollers 86 are axially supported rotatably and fixed in two portions in the direction for moving up and down with the portion to which the first stack tray 26 is fixed therebetween. The outer range of the slide rollers 86 is fitted into the up-and-down rail 85 slidably.

Concurrently therewith, a rack 26*r* is integrally formed in the tray base 26*x*, while being aligned in the up-and-down direction. The rack 26*r* meshes with gear teeth formed in a drive pinion 87 axially supported by the apparatus frame 55*a*. Moreover, further outside the outer range of the drive pinion 87, a worm wheel 88 is integrally formed, and is coupled to an up-and-down motor M10 via a worm gear 89. The up-and-down motor M10 is also fixed to the apparatus frame 55*a*.

Accordingly, when the up-and-down motor M10 is rotated forward and backward, the rack 26*r* coupled to the drive pinion 87 moves up and down, upward and downward with respect to the apparatus frame 55*a*. By this mechanism, the tray base 26*x* operates up and down in a state of cantilever-supporting the end portion of the first stack tray 26 on the upstream side in the sheet discharge direction. In FIG. 8, as the mechanism for moving the tray up and down, the description is given to the mechanism using the rack and pinion, and as well as such a mechanism, it is possible to adopt a mechanism for looping a belt between pulleys, and rotating the pulley with a motor to move up and down, and the like.

Further, the stack surface of the first stack tray 26 integrally attached to the tray base 26*x* is set for a predetermined angle (e.g. 20° to 60°) so as to lower the upstream side in the discharge direction so that the rear end of a bunch of sheets in the discharge direction strikes a tray alignment surface 55*f* under its own weight.

The up-and-down rail 85 for guiding the direction in which the tray base 26*x* shifts is extended in the direction for moving the first stack tray 26 up and down with an in-body installation face 36 where the sheet binding unit 32 is installed in the sheet discharge space 19 therebetween. By this means, it is possible to move the first stack tray 26 down below the in-body installation face 36, and it is possible to stack sheets in a range wider than the sheet discharge space 19.

A drive section, which is comprised of the up-and-down motor M10 provided with the drive pinion 87 with the worm wheel 88 integrally formed and the worm gear 89 to move the so-called tray up and down, is disposed below the in-body installation face 36 where the sheet binding unit 32 is installed in the sheet discharge space 19. Further, the drive section is disposed in a portion where the apparatus frame 55*a* extends in the direction in which the first stack tray 26 moves up and down, on the side of the exterior of the image forming unit A.

By this means, as compared with the case where the drive section is disposed above the in-body installation face 36, by the combination of one up-and-down motor M10 and rack 26*r*, it is made ease to widen a range for moving the first stack tray 26 up and down. Further, the first stack tray 26 is set for a lower limit position for preventing the tray from descending abnormally, and in the lower limit position is disposed a limit sensor Se3 for detecting the tray.

In the drive section for moving the first stack tray 26 up and down, since the first stack tray 26 in a position that is the most downstream in the discharge direction of the sheet, the tray base 26*x* to which the first stack tray 26 is fixed, and the rack 26*r* formed in the position opposed to the first stack tray 26 of the tray base 26*x* are disposed in this order, the drive section is disposed below a portion extended outside the body of a second binding unit cover 45*b* between the rack 26*r* formed in the tray base 26*x* and the exterior casing 55*b* extended along the side of the image forming unit A.

The up-and-down motor M10 is disposed with the rotating shaft of the motor inclined a predetermined angle with respect to the direction for extending the side 90 of the image forming unit A, between the rack 26*r* and the exterior casing 55*b* extended along the side of the image forming unit A, and is fixed to the apparatus frame 55*a*. By this means, as compared with the arrangement where the rotating shaft of the motor is disposed parallel with the direction for extending the side 90 of the image forming unit A, it is possible to arrange the up-and-down motor M10 in small space.

By arranging the up-and-down motor M10 obliquely, the worm bear 89 fixed to the motor shaft to rotate together approaches the exterior casing 55*b*. In attaching the sheet binding unit 32 to the image forming unit A, when attachment is performed with a face for delivering the sheet from the relay transport unit 31 to the sheet binding unit 32 as reference, a portion of the exterior casing 55*b* extended in the direction for moving the first stack tray 26 up and down is distorted, and the risk occurs that the exterior casing 55*b* interferes with the worm gear 89.

Therefore, a regulation face to position in installation is made an extended face 91 of the exterior casing brought into contact with the side 90 of the image forming unit A of the exterior casing 55*b* extended in the direction in which the first second tray 26 moves up and down. By this means, since a fix position of the sheet binding unit 32 to the image forming unit A is regulated on the extended face 91 of the exterior casing near the drive section, the risk does not occur that the exterior casing 55*b* interferes with the worm gear 89.

[Operation Section]

Figure 9:
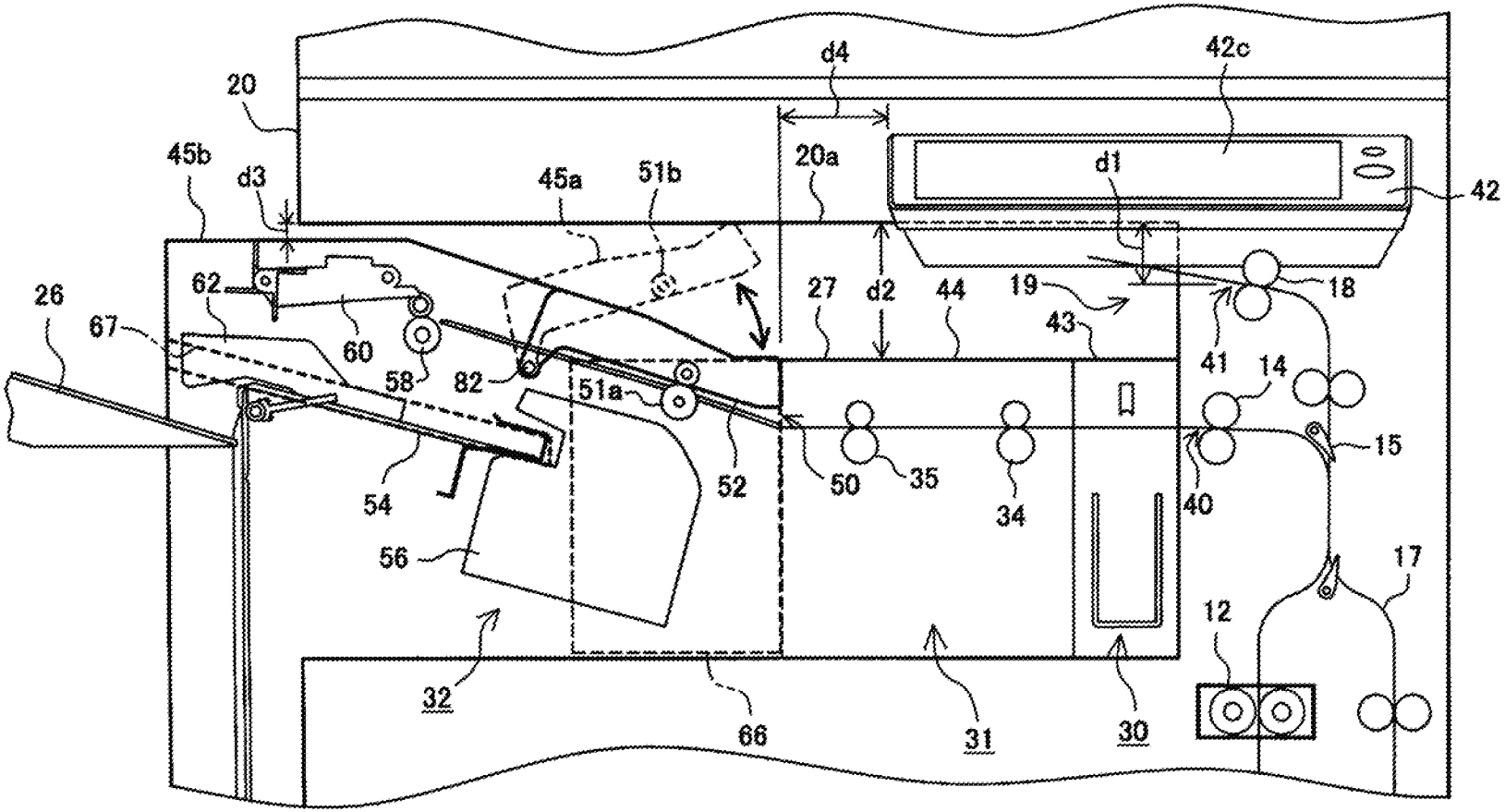
FIG. 9 is a configuration explanatory view of a second stack tray in a sheet post-processing unit shown in FIG. 1.

The operation section 42 shown in FIG. 9 is provided with an operation input section 42*a* that receives input to each of the image read unit C, image forming unit A, and sheet post-processing unit B, and an operation display section 42*b* that performs display output of various kinds of information. The image forming apparatus is provided with a substantially plate-shaped operation panel section 42*c*. Further, the operation panel section 42*c* has a touch panel on its front side. The touch panel is configured by embedding piezoelectric sensors and the like in a liquid crystal display panel, and is able to receive operation input from an operator, while displaying various kinds of information. For example, a menu image is displayed on the touch panel. The operator presses a button (button-shaped image) virtually disposed inside the touch panel, and is thereby capable of setting various types of operation of the image forming apparatus, and the like. The touch panel functions as a part of the operation input section 42*a*, while functioning as a part of the operation display section 42*b*.

The operation section 42 is fixed inside a casing integrally formed with an exterior casing of the image read apparatus 20, or is fixed to an exterior casing, which is a different body from the exterior casing of the image read apparatus 20, via a rotatable attachment tool such as a hinge. In both configurations, the section protrudes from the front side of the image read apparatus 20, and is disposed in a position for overlapping with the first discharge outlet 40 and second discharge outlet 41 on the side where the original document stacker 25 of the image read unit C is disposed.

[Second Stack Tray]

Using FIG. 9, the description will be given to a second stack tray 27 provided above the sheet post-processing unit B. The second stack tray 27 is formed of a joint arrangement of the punch unit cover 43, relay unit cover 44 and binding unit cover 45 that are exterior casings provided in the uppermost position of respective units of the punch unit 30, relay transport unit 31 and sheet binding unit 32, disposed in the sheet discharge space 19.

The punch unit cover 43 and relay unit cover 44 are formed of a flat face held horizontally with respect to the discharge direction of the sheet. A distance from a bottom 20*a* of the image read apparatus 20 disposed above the punch unit cover 43 and relay unit cover 44 is also set substantially uniformly.

The binding unit cover 45 holds the horizontal shape continued from the relay unit cover 44 near the carry-in entrance 50 adjacent to the relay unit cover 44, and is formed with an inclined angle upward from a portion on the upstream side of the carry-in roller 51 in the sheet discharge direction. Then, the cover is a flat surface again substantially horizontally in a portion on the downstream side of the sheet discharge roller 58 in the sheet discharge direction, and the flat surface extends astride from inside the body to outside the body of the apparatus, toward above the first stack tray 26 positioned outside the body, from the sheet discharge space 19 positioned inside the body of the image forming apparatus.

The second discharge outlet 41 to which the sheet is discharged from the second main body discharge roller 18 of the image forming unit A is spaced a distance of d1 apart from the bottom 20*a* of the image read apparatus 20. The top surface of the punch unit cover 43 and relay unit cover 44 is spaced a distance of d2 apart from the bottom 20*a* of the image read apparatus 20. Lengths of d1 and d2 are set at lengths of d1<d2. Therefore, a height difference is formed from the second discharge outlet 41 to the top surface of the punch unit cover 43 and relay unit cover 44, and it is thereby possible to stack sheets carried out of the second discharge outlet 41.

The binding unit cover 45 is comprised of a first binding unit cover 54*a* (open cover) with the carry-in entrance 50 as one end portion, and a second binding unit cover 45*b* having a portion extended above the first stack tray 26 positioned outside the body outside the sheet discharge space 19. The first binding unit cover 45*a* is attached rotatably to open the carry-in entrance 50 50 of the sheet carry-in path 52, with a cover axis shaft 82 fixed to the apparatus frame 55*a* as an axis. In other words, the sheet stacking space of the second stack tray is used also as a region where the first binding unit cover 45*a* rotates.

In the roller pair of the carry-in roller 51, a carry-in roller 51*b* (driven roller) following a carry-in roller 51*a* (drive roller) on the drive side is axially supported by the first binding unit cover 45*a* rotatably, and is biased toward the carry-in roller 51*a* by an elastic member not shown. When the first binding unit cover 45*a* is opened upward, since the carry-in roller 51*b* supported by the cover follows, a nip of the carry-in roller 51 is released.

By the nip release of the carry-in roller 51, in the case where transport is halted (hereinafter, referred to as "jam") for some reason between the second relay transport roller of the relay transport unit 31 and the carry-in roller 51 of the sheet binding unit 32, it is possible to easily access the jammed sheet, and the operator is capable of removing the sheet halted in the sheet carry-in path 52.

Further, also in the case where a jam occurs between the carry-in roller 51 and the sheet discharge roller 58 of the sheet binding unit 32, it is possible to easily access the jammed sheet to remove the sheet. An end portion of the first binding unit cover 45*a* on the carry-in entrance 50 side is disposed in a position spaced a predetermined distance further on the downstream side apart from an end portion of the operation section 42 on the downstream side in the sheet discharge direction. Specifically, a length d4 from one end portion of the operation section 42 to the carry-in entrance 50 shown in FIG. 9 is set at about 50 mm to 70 mm. By this means, it is possible to easily access an opening portion of the first binding unit cover 45*a*.

Further, with respect to one end of the first binding unit cover 45*a* on the carry-in entrance 50 side, the cover axis shaft that is the rotation axis of the first binding unit cover 45*a* is disposed above. By this height difference, it is possible to widely open one end on the carry-in entrance 50 side, at a small rotation angle of the first binding unit cover 45*a*. By this means, it is made ease to access the jammed sheet in the sheet carry-in path 52.

The second binding unit cover 45*b* is formed of a portion with the same angle as the inclined angle formed by the first binding unit cover 45*a* described previously, and the substantially horizontal flat surface again in the portion on the downstream side of the sheet discharge roller 58 in the sheet discharge direction. The flat surface is spaced a distance of d3 from the bottom 20*a* of the image read apparatus 20. In other words, in the second stack tray 27, the surface capable of stacking sheets is extended from inside the body to outside the body of the apparatus toward the discharge direction of the sheet, and it is thereby possible to stack longer sheets on the tray to hold. Further, when a long sheet exceeding the second binding unit cover 45*b* on the downstream side in the discharge direction of the sheet is carried out of the second discharge outlet, the first stack tray 26 is capable of accepting the front end of the sheet.

[Staple Replacement Cover]

In the explanation as described above, the binding means is described using FIG. 5, and as the mechanism of the binding processing, the sheet binding unit 32 is provided with the first binding means 56 for performing the binding processing on a bunch of sheets using needles such as staples, and the second binding means 57 for pressing and deforming a bunch of sheets to perform the binding processing without using needles or the like. The first binding means 56 performs the binding processing using staples, and therefore, it is necessary to refill the means when staples are used up.

In refilling the means with staples, the first binding means 56 is shifted to the manual binding position Mp1 by a drive means not shown, and is further rotated a predetermined angle toward the staple replacement cover 66 to halt. The staple replacement cover 66 is axially supported by a staple replacement cover axis 66*x*, and is fixed to the exterior casing 55*b* rotatably with one end of the sheet binding unit 32 on the carry-in entrance 50 side (on the downstream side in the sheet discharge direction) as an opening portion.

One end of the staple replacement cover 66 on the downstream side in the sheet discharge direction is disposed in a position spaced the predetermined distance (length d4) further on the downstream side apart from the end portion of the operation section 42 on the downstream side in the sheet discharge direction, as in the first binding unit cover 45*a* described previously. Accordingly, in replacing staples, access to the staple replacement cover 66 is good, and the operation section 42 does not interfere with staple replacement.

[Explanation of a Control Configuration]

Figure 10:
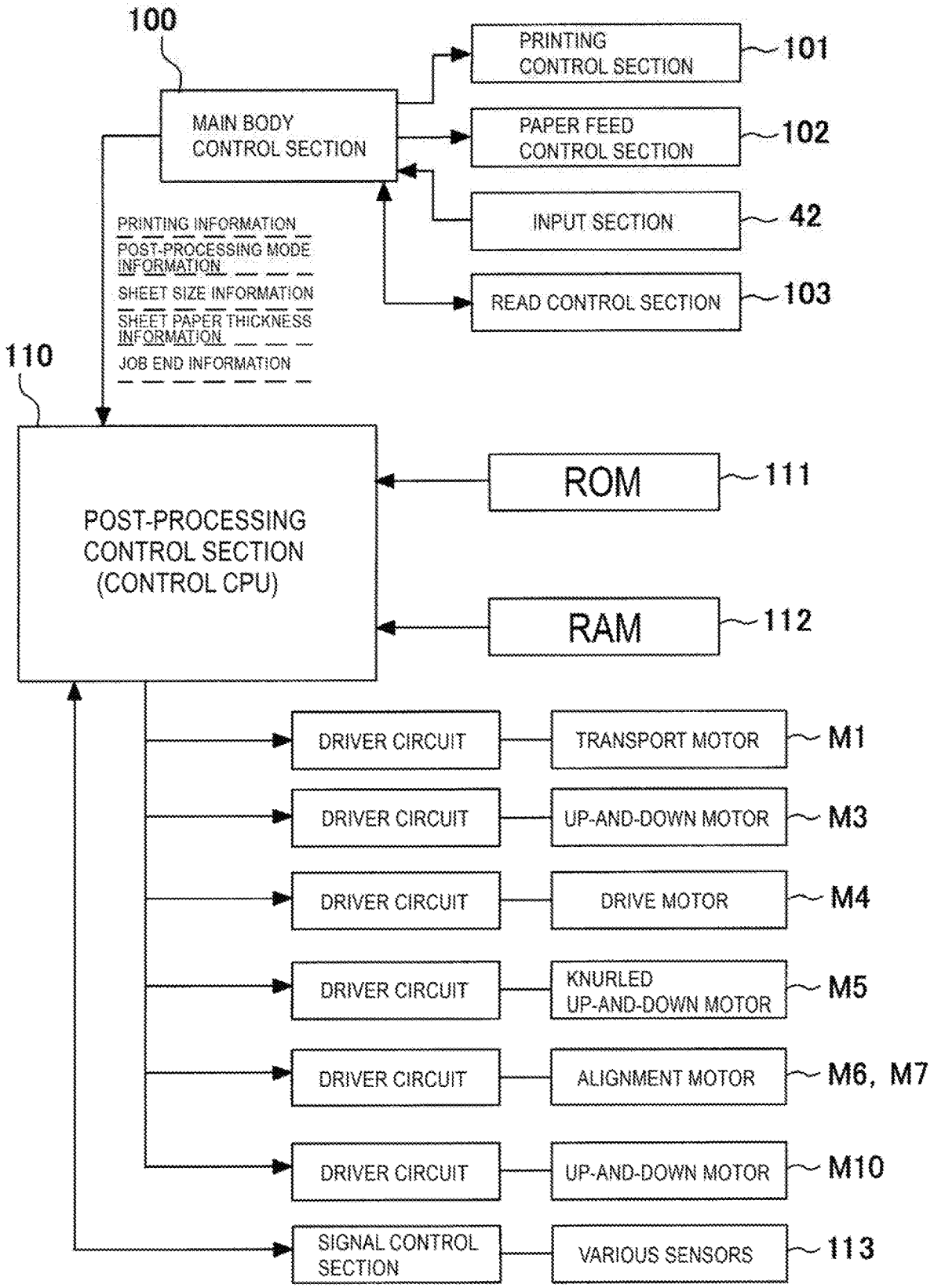
FIG. 10 is an explanatory diagram of a control configuration in the apparatus of FIG. 1.

The control configuration of the above-mentioned image forming system will be described according to a block diagram of FIG. 10. The image forming system shown in FIG. 10 is provided with a control section 100 (hereinafter, referred to as "main body control section") of the image forming unit A, and a control section 110 (hereinafter, referred to as "post-processing control section") of the post-processing unit B (sheet bunch binding processing apparatus; the same in the following description). The main body control section 100 is provided with a printing control section 101, paper feed control section 102, read control section 103 and input section (operation section 42).

Then, settings of "image formation mode" and "post-processing mode" are made from the input section 42. The image formation mode is to make mode settings of color—monochrome printing, two-side—one side printing and the like, and to set image formation conditions of sheet size, sheet paper quality, the number of printout copies, scaling printing and the like. Further, for example, the "post-processing mode" is set for "printout mode", "staple binding processing mode", "eco-binding processing mode", "jog sorting mode" or the like. In addition, the apparatus shown in the figure is provided with a "manual binding mode", and in this mode, binding processing operation of a bunch of sheets is executed offline independently of the main body control section 100 of the image forming unit A.

Further, the main body control section 100 transfers data of the post-processing mode, the number of sheets, number-of-copy information, paper thickness information of sheets undergoing image formation, and the like to the post-processing control section 110. Concurrently therewith, the main body control section 100 transfers a job end signal to the post-processing control section 110 whenever image formation is finished. Further, in this Embodiment, the section 100 transfers printing information, particularly, information on a discharge amount of ink to the sheet to the post-processing control section 110.

Moreover, as the information for the main body control section 100 of this Embodiment to transfer to the post-processing control section 110, as well as the above-mentioned information, the section 100 transfers printing information (for example, a discharge amount of ink to the sheet and image information read with the image read unit C, or information on an ink discharge amount, printing rate and the like calculated form the image information) to the post-processing control section 110.

[Explanation of Bunch Discharge Processing]

Since the image forming section 2 of this Embodiment adopts the inkjet type, when printing is performed using a large amount of ink with respect to a sheet (for example, printing of overall solid image), the sheet becomes heavy due to moisture of the ink. When a plurality of such heavy sheets is stacked on the processing tray 54 to form a bunch of sheets, and the bunch is discharged to the first stack tray 26 as in a normal bunch of sheets, a drive force of the sheet bunch discharge means 70 loses against weight of the bunch of sheets, and there is a possibility that the bunch is normally not discharged.

In this Embodiment, the post-processing control section 110 controls drive (drive motor M4) of the sheet bunch discharge means 70 based on weight information of a bunch of sheets formed on the processing tray 54, and it is thereby configured to be able to normally discharge a bunch of heavy sheets also to the first stack tray 26.

<Acquisition of Weight Information of a Bunch of Sheets>

The post-processing control section 110 of this Embodiment acquires or calculates (detects) the weight information of a bunch of sheets by one of the following methods (or combination thereof). (1) Calculate weight of a bunch of sheets from ink discharge amount information (which may be an amount actually discharged from each head of 2C, 2M, 2Y and 2K, or may be an ink discharge amount calculated from printing image information) transferred from the main body control section 100. (2) Calculate weight of a bunch of sheets by that the main body control section 100 transfers the printing image information to the post-processing control section 110, and that the post-processing control section 110 side calculates an ink discharge amount. In addition, the printing image information is image information read with the image read unit C. Then, by combining the information of each of above-mentioned (1) and (2) and information on the number of sheets, sheet type, and the presence or absence of two-side printing, weight of the entire bunch of sheets is obtained.

Further, it is also possible to detect weight of a bunch of sheets on the sheet post-processing unit B side. For example, (3) directly detect weight of a bunch of sheets by providing the processing tray 54 with a weight sensor 113. (4) Calculate a printing rate (ink discharge amount) by providing the sheet transport path of the sheet post-processing unit B with an image read section such as a camera, and distinguishing between a white portion of the sheet and the other portion from the read image information. (5) Calculate weight by providing the sheet transport roller pair with a detection sensor (113) for detecting the moisture content of a sheet, and detecting the moisture content of the transported sheet. In addition, by combining the information of each of the above-mentioned (4) and (5) and information on the number of sheets and sheet type, weight of the entire bunch of sheets is obtained. Further, with respect to (4) and (5), instead of the sheet post-processing unit B side, by providing the image forming unit A side with the image read section and moisture content sensor, the information may be acquired via the main body control section 100.

In addition, in order for the post-processing control section 110 to determine that "a bunch of sheets is heavy", as a matter of course, the section does not need to calculate weight of a bunch of sheets, each piece of information to acquire is set for a threshold, and when the information exceeds the threshold, the section 110 may determine that the bunch of sheets is heavy.

Further, although an ink discharge amount (or moisture content of a sheet) is large, in the case where the number of sheets is low in a bunch of sheets formed at a time on the processing tray 54, it is possible to determine that the bunch of sheets is not heavy. Conversely, although an ink discharge amount is small, in the case of forming a bunch of sheets using a large amount of thick sheets, it is possible to determine that the bunch of sheets is heavy. In other words, in the methods except the method (3) of directly detecting weight of a bunch of sheets, it is necessary to set a threshold by combining an ink discharge amount (sheet moisture content or printing rate) and information on the number of sheets, sheet type (size, material, weighing capacity, etc.) and printing mode (one-side or two-side).

<Processing in the Case of Determining that a Bunch of Sheets is Heavy>

As the reason that transport of a heave bunch of sheets is difficult, there is a lack of torque of the drive motor M4 of the sheet bunch discharge means 70. Generally, to improve the processing speed, the bunch discharge processing is performed at a high speed as high as possible. However, when the bunch discharge processing is performed at a normal speed, there is a possibility that the torque of the drive motor M4 lacks, and that it is not possible to perform the bunch discharge processing.

Therefore, in the case of determining that weight of a bunch of sheets is heavier than predetermined weight based on the above-mentioned (1) to (5), the post-processing control section 110 controls drive of the sheet bunch discharge means 70 by one of the following methods (or combination thereof), and causes the means 70 to discharge the heavy bunch of sheets to the first stack tray 26.

(I) Decrease the rotation velocity of the drive motor M4. By this means, although the processing speed is lower than normal processing, since high torque is obtained at a velocity lower than the rotation velocity of the drive motor M4 of normal bunch discharge processing (in the case of recognizing that a bunch of sheets formed on the processing tray 54 is light), it is possible to reliably push a bunch of sheets out to the first stack tray 26. (II) Moderate an acceleration curve of the drive motor M4. In an acceleration range for changing the rotation velocity of the motor, acceleration torque is required, in addition to normal operation torque. Since the acceleration torque is increased/decreased with acceleration time (acceleration curve), by moderating the acceleration curve, the acceleration torque required for the drive motor M4 is low, and the motor does not lose synchronization. The above-mentioned (I) is an aspect where the rotation velocity of the drive motor M4 is decreased from the first to the last of bunch discharge operation, and generally, when a heavy product is moved, a force is required in starting to move. In order for the motor not to loss synchronization at this point, the rotation velocity of the drive motor M4 is decreased at the time the first bunch transport member 70A starts to shift a bunch of sheets. Subsequently, the velocity may be set at the same as the normal rotation velocity finally. By this means, although the processing speed of the bunch discharge processing is lower than the normal speed, the processing speed is improved more than the aspect of the above-mentioned (I). (III) Increase a current amount applied to the drive motor M4. Since the drive motor M4 is a pulse motor, when the current amount applied to the drive motor M4 is increased, the torque is increased. When the current amount is increased every time, power consumption is increased. However, by increasing only in the case of determining that a bunch of sheets is heavy, it is possible to actualize improvement in accuracy of the bunch discharge processing and power saving with balance.

The sheet bunch discharge means 70 of this Embodiment is a scheme for pushing a bunch of sheets, and in addition to the first bunch transport member 70A and second bunch transport member 70B thereof, discharge of a bunch of sheets may be assisted, using a nip roller pair for nipping a bunch of sheets to transport, and a paddle rotating body. Also in drive thereof, when a bunch of sheets is heavy, by decreasing the rotation velocity or increasing a current amount, accuracy of bunch discharge is improved.

In addition, this application claims priority from Japanese Patent Application No. 2018-22536 incorporated herein by reference.

The invention claimed is:

1. A sheet stacking apparatus for receiving sheets subjected to printing processing in an image forming apparatus and forming a bunch of sheets to discharge, comprising:

a first sheet placement section adapted to place a sheet;

a sheet bunch forming section adapted to form a bunch of sheets including the sheet in a state in which the sheets are supported on the first sheet placement section;

a sheet bunch shift section adapted to shift the bunch of sheets formed by the sheet bunch forming section in a predetermined shift direction;

a drive section adapted to drive the sheet bunch shift section;

a second sheet placement section adapted to place the bunch of sheets shifted by the sheet bunch shift section;

a control section adapted to receive information on an ink discharge amount in performing the printing processing on the sheet from an image forming apparatus side, and control the drive section to increase a transport force per unit time in shifting the bunch of sheets with the sheet bunch shift section, when the ink discharge amount is larger than a predetermined amount, as compared with a case that the ink discharge amount is smaller than the predetermined amount.

2. The sheet stacking apparatus according to claim 1, further comprising:

a read section adapted to read a printed sheet, wherein the recognizing section recognizes weight of the bunch of sheets, using a read result in the read section.

3. The sheet stacking apparatus according to claim 1, further comprising:

a moisture content detecting section adapted to detect a moisture content of the sheet provided with the printing processing, wherein the recognizing section recognizes weight of the bunch of sheets, using a detection result in the moisture content detecting section.

4. The sheet stacking apparatus according to claim 1, wherein further based on information on the number of sheets of a bunch of sheets formed at a time, sheet type and/or the presence or absence of two-side printing, the control section is adapted to control the drive section.

5. The sheet stacking apparatus according to claim 1, further comprising:

a weight detecting section adapted to detect weight of a bunch of sheets, in a sheet placement portion of the first sheet placement section, wherein the recognizing section recognizes weight of the bunch of sheets, using a detection result in the weight detecting section.

6. The sheet stacking apparatus according to claim 1, wherein the drive section includes a motor to shift the sheet bunch shift section, and when the ink discharge amount is larger than a predetermined amount, the control section increases a current amount applied to the motor, as compared with the case that the ink discharge amount is smaller than the predetermined amount.

7. The sheet stacking apparatus according to claim 6, wherein the drive section includes a motor to shift the sheet bunch shift section, and when the ink discharge amount is larger than a predetermined amount, the control section decreases a rotation velocity of the motor, as compared with the case that the ink discharge amount is smaller than the predetermined amount.

8. An image forming system comprising:

an image forming section adapted to perform the printing processing on the sheet; and the sheet stacking apparatus according to claim 1.

9. A sheet stacking apparatus for receiving sheets subjected to printing processing in an image forming apparatus and forming a bunch of sheets to discharge, comprising:

a first sheet placement section adapted to place a sheet;

a sheet bunch forming section adapted to form a bunch of sheets including the sheet in a state in which the sheets are supported on the first sheet placement section;

a sheet bunch shift section adapted to shift the bunch of sheets formed by the sheet bunch forming section in a predetermined shift direction;

a drive section adapted to drive the sheet bunch shift section;

a second sheet placement section adapted to place the bunch of sheets shifted by the sheet bunch shift section; and a control section adapted to receive printing image information in performing the printing processing on the sheet from an image forming apparatus side, calculate an ink discharge amount in performing the printing processing on the sheet from the printing image information, and control the drive section to increase a transport force per unit time in shifting the bunch of sheets with the sheet bunch shift section, when the ink discharge amount is larger than a predetermined amount, as compared with a case that the ink discharge amount is smaller than the predetermined amount.

10. The sheet stacking apparatus according to claim 9, wherein further based on information on the number of sheets of a bunch of sheets formed at a time, sheet type and/or the presence or absence of two-side printing, the control section is adapted to control the drive section.

11. The sheet stacking apparatus according to claim 9, wherein the drive section includes a motor to shift the sheet bunch shift section, and when the ink discharge amount is larger than a predetermined amount, the control section increases a current amount applied to the motor, as compared with the case that the ink discharge amount is smaller than the predetermined amount.

12. An image forming system comprising:

an image forming section adapted to perform the printing processing on the sheet; and the sheet stacking apparatus according to claim 9.

* * * * *